United States Patent [19]

Sugiyama et al.

[11] 4,422,423

[45] Dec. 27, 1983

[54] JET CONTROL TYPE CARBURETOR

[75] Inventors: Katsuhiko Sugiyama, Aichi; Katsuyuki Ohsawa, Nagoya; Kenji Fujikake, Nagoya; Yoshinori Idota, Nagoya, all of Japan

[73] Assignee: Kabushiki Kaisha Toyota Chuo Kenyusho, Aichi, Japan

[21] Appl. No.: 140,955

[22] Filed: Apr. 16, 1980

[30] Foreign Application Priority Data

| | | | |
|---|---|---|---|
| Apr. 24, 1979 | [JP] | Japan | 54-50569 |
| Apr. 28, 1979 | [JP] | Japan | 54-53247 |
| Apr. 28, 1979 | [JP] | Japan | 54-53248 |
| Sep. 10, 1979 | [JP] | Japan | 54-115986 |
| Nov. 10, 1979 | [JP] | Japan | 54-145694 |
| Dec. 29, 1979 | [JP] | Japan | 54-173567 |
| Dec. 29, 1979 | [JP] | Japan | 54-173568 |

[51] Int. Cl.[3] ..... F02B 33/00; F02M 7/00

[52] U.S. Cl. ..... 123/438; 123/437; 123/439; 261/30; 261/41 D; 261/78 R; 261/Dig. 39

[58] Field of Search ..... 123/440, 437, 438, 585, 123/589; 261/DIG. 39, 30, 41 D, 78 R, DIG. 82

[56] References Cited

U.S. PATENT DOCUMENTS

| | | | |
|---|---|---|---|
| 2,541,316 | 2/1951 | Winkler | 261/DIG. 39 |
| 2,595,720 | 5/1952 | Snyder | 261/DIG. 39 |
| 3,347,536 | 10/1967 | Sutton | 261/DIG. 39 |
| 3,841,283 | 10/1974 | Wood | 60/276 |
| 3,921,612 | 11/1975 | Aono | 123/440 |
| 4,023,357 | 5/1977 | Masaki | 123/589 |
| 4,036,186 | 7/1977 | Hattori et al. | 123/438 |
| 4,091,783 | 5/1978 | Laprade | 123/589 |

FOREIGN PATENT DOCUMENTS

| | | | |
|---|---|---|---|
| 448307 | 5/1975 | U.S.S.R. | 261/DIG. 39 |

*Primary Examiner*—Ronald B. Cox

*Attorney, Agent, or Firm*—Oblon, Fisher, Spivak, McClelland & Maier

[57] ABSTRACT

A jet control type carburetor according to the present invention includes an intake pipe having an intake passage formed in an inner wall thereof, the intake passage allowing an intake air to flow therethrough; a venturi provided in the intake pipe, for controlling flow velocity and pressure of the intake air in the intake passage; a fuel nozzle opened into the intake passage and connected to a fuel supply source through a fuel passage for sucking the fuel within the intake passage from the fuel nozzle in order to introduce the mixture of air and fuel within the intake passage; a throttle valve provided downstream of the venturi, for controlling the flow rate of the mixture of intake air and fuel; a control fluid nozzle opened into the intake passage and connected to a fluid supply source through a control fluid passage for jetting the flow of the control fluid to the fuel spurted from the fuel nozzle to afford the kinetic energy of the control fluid to the fuel, and a throttle means provided upstream of the control fluid nozzle in the control fluid passage, for controlling the flow rate of the control fluid; whereby the fuel flow rate and the mixing condition of the fuel and the air are controlled with high stability and response by the kinetic energy of the control fluid so that the exhaust gas purification and the fuel consumption are improved by controlling accurately the air-fuel ratio of the intake mixture.

50 Claims, 54 Drawing Figures

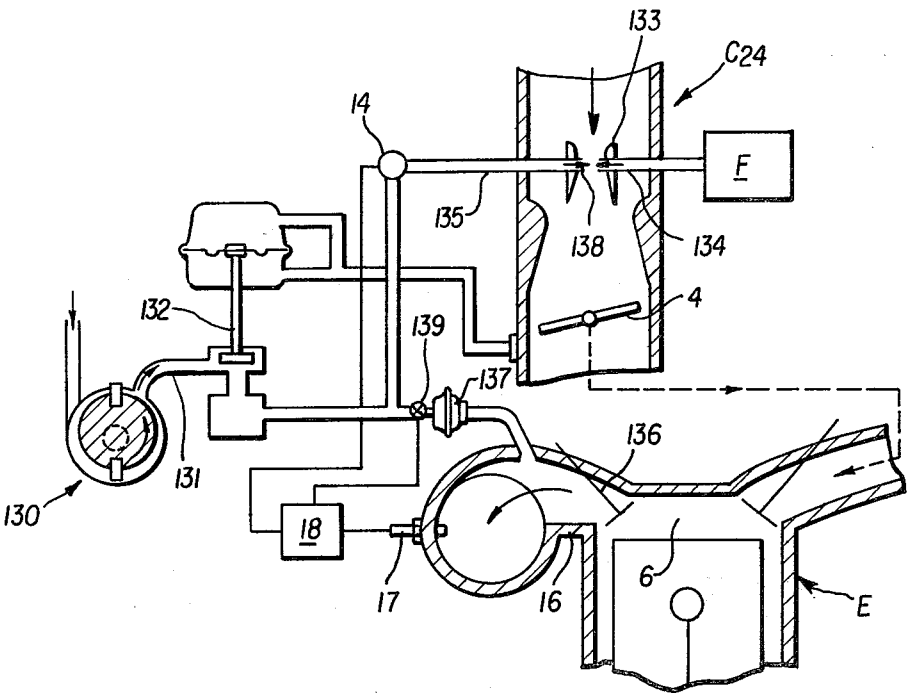
FIG. 54
FIG. 38
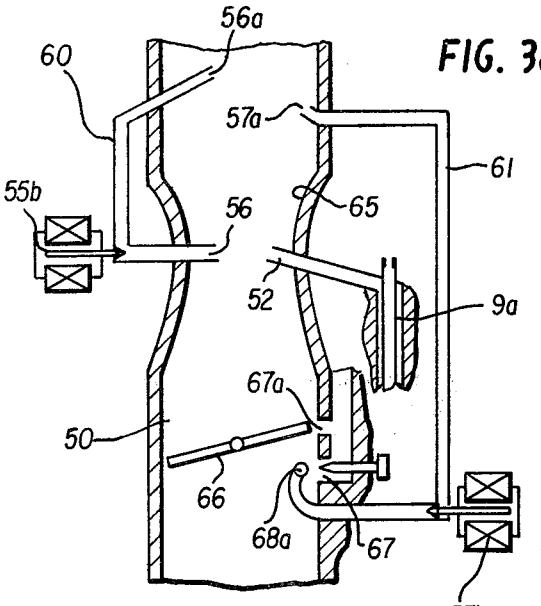
FIG. 39
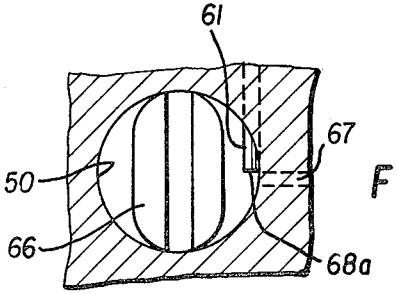

JET CONTROL TYPE CARBURETOR

BACKGROUND OF THE INVENTION

1. Field of the Invention

The present invention relates to a carburetor of the type in which a fluid nozzle is disposed in a venturi to blow a jet into the fuel from a fuel nozzle thereby to impart a kinetic energy thereto so that the flow rate of the fuel to emanate from the fuel nozzle into an intake pipe may be controlled to accurately, stably and smoothly control the mixing ratio between the intake air and the fuel.

2. Description of the Prior Art

In a carburetor C according to the prior art, as shown in FIG. 1, the intake air flowing through an intake pipe 1 is mixed with a fuel under an emulsion condition, which is sucked and introduced through both such a main nozzle 3 as is opened into a venturi 2 arranged in the intake pipe 1 and such slow and idle ports 5*a* and 5*b* as are opened in the vicinity of a throttle valve 4 arranged downstream of the venturi 2 to form a combustible mixture, thereby to prepare the air-fuel mixture, which is fed to a combustion chamber 6.

In the prior art caburetor C, moreover, the air-fuel ratio is determined by the fuel flow rate, which is set by the vacuum pressure in the venturi 2 or at the throttle valve 4, to the flow rate of the intake air, which is set by the opening of the throttle valve 4. Thus, the main and slow jets 7 and 8 in a fuel passage are so selected as to prepare a preset air-fuel ratio. This air-fuel ratio is, however, liable to be fluctuated in accordance with the running conditions (such as the R.P.M., load or temperature) of an engine E.

As the means in the conventional carburetor C for controlling the air-fuel ratio, therefore, there have been proposed a concept, in which bleed air is mixed in advance and the bleed flow rate of the air to be additionally mixed is controlled by air bleeds 9*a* and 9*b* upstream of the main nozzle 3 and the slow port 5*a*, and another concept in which their controls are effected by varying the effective areas of the main nozzle 3, the main jet 7 and the slow jet 8.

According to the former concept, however, the flow modes such as the bubble flow, the slag flow or the piston flow are varied by the flow rate of the bleed air. Moreover, these variations in the flow modes are invited by the flow rate of the additional bleed air. As a result, even if it is intended to control the air-fuel ratio by mixing the additional bleed air under the condition having the instable flow mode, the flow rate itself of the additional bleed air becomes so instable that the air-fuel ratio can not be effected to a satisfactory extent.

In fact, the Inventors have confirmed that the timely fluctuations in the bleed air flow rate are so high as to invite practical problems. In view of these, according to the air bleed flow rate control, pulsations take place in the fuel, which is to be sucked and introduced from the main nozzle 3 or the slow port 5*a*, thereby to invite practical problems in the responsiveness and controllability. As a result, the mixture of a proper air-fuel ratio cannot be prepared, and the supply of the improper mixture to the combustion chamber 6 results in the fluctuations in the output of the engine E thereby to invite the deteriorations in the engine performance and drivability and the emission of noxious contents in the engine exhaust gases.

Moreover, the aforementioned air bleeds 9*a* and 9*b* function partly to effect the excellent atomization of the fuel and partly to improve the transient characteristics between the main system for supplying the main nozzle 3 with the fuel and the slow system for supplying the slow and idle ports 5*a* and 5*b* with the fuel.

As shown in FIGS. 2 and 3, more specifically, the improvements in the transient characteristics are performed such that the condition, under which the air-fuel ratio temporarily becomes excessively high to provide a lean mixture in the range where the air flow rate is gradually increased so that the discharge of the fuel from the main system is started, is shifted to the lower or richer side of the air fuel ratio by the actions of the air bleeds 9*a* and 9*b*.

In FIG. 2, the ordinate and the abscissa respectively show the fuel flow rate (Gf) and the air flow rate (Ga), wherein line CN shows Ga/Gf is constant, lines T, M and S respectively show the total fuel flow rate, the fuel flow rate through a main system and the fuel flow rate through a flow system.

On the other hand, in FIG. 3, the ordinate and the abscissa respectively show the air-fuel ratio (A/F) and the air flow rate (Ga), wherein lines D and I respectively show A/F in the case of no air bleed and A/F in the case of with air bleed.

In practice, however, the air bleeds 9*a* and 9*b* don't play such an important role for the fuel atomization in the carburetor C but is rather effective in the improvements in the transient characteristics. Thus, the air bleeds 9*a* and 9*b* improve the air-fuel ratio in the transient phase but generate the aforementioned pulsations in the fuel discharge thereby to induce the fluctuations in the fuel discharge in the ranges other than that of the transient characteristics with the resultant problem that the control of the air-fuel ratio becomes difficult.

According to the aforementioned latter concept, the requirement for drastic changes in the conventional carburetor and the complexity in construction to vary the effective areas of the main nozzle 3 and the main and slow jets 7 and 8 requires the highly precise machining, and to further finely control the diameters relating thereto is technically difficult at present.

According to one of the means for solving the problems thus far described, atmospheric pressure is introduced into the venturi to establish the pressure change so that the flow rate to be sucked and introduced into the venturi may be controlled and improved. However, the several series of experiments and analyses conducted by the Inventors have confirmed that a proper control of the air-fuel ratio over a wide range cannot be expected in the least.

SUMMARY OF THE INVENTION

In order to eliminate the problems concomitant with the prior art, it is therefore an object of the present invention to provide a jet control type carburetor which can finely control the flow rate of fuel, which is excellent in the responsiveness and stability in the flow rate control and which can practise the most proper control of the air-fuel ratio in accordance with the various running conditions of an engine while simplifying the construction, thereby to provide an excellent fuel consumption and excellent effect in the purification of the exhaust gases.

A primary object of the present invention is to provide a carburetor which allows a jet as a control fluid to be blown into the fuel spurting from the fuel nozzle to impart a predetermined velocity component of the control fluid having a contrary stream to that of the fuel spurted from the fuel nozzle thereby to suppress and control the fuel flow rate so that the air-fuel ratio of the intake mixture is controlled to the most suitable condition.

Another object of the present invention is to provide a carburetor which has a low fuel consumption rate and excellent exhaust gas purification effect by controlling the air-fuel ratio to the most suitable condition.

Still another object of the present invention is to provide a carburetor which controls the air-fuel ratio and the mixing condition between the intake air and the fuel with excellent stability and responsiveness.

A further object of the present invention is to provide a carburetor which has a low fuel consumption rate and stable combustion by improving the mixing between the intake air and the fuel so that the control relative thereto is so simplified as to improve the reliability and durability and to simplify the construction of the system as a whole.

A still further object of the present invention is to provide a carburetor which allows the control of the fuel flow rate to be accomplished in the intake pipe so that the delay time in the response is remarkably shorter than that of the prior art.

A further object of the present invention is to provide a carburetor which allows a jet as a control fluid to be blown from a control fluid nozzle toward the fuel by utilizing the pressure difference within the intake passage thereby to impart the kinetic energy to the fuel so that the fuel flow rate is properly controlled in accordance with the engine running condition.

A further object of the present invention is to provide a carburetor which allows a jet as a control fluid to be blown toward the fuel by the pressurized air supplied from the control fluid nozzle to impart the a predetermined velocity component of the control fluid having a contrary stream to that of the fuel spurted from the fuel nozzle thereby to control the mixing ratio between the intake air and the fuel.

A further object of the present invention is to provide a carburetor in which the pressurized air as a control fluid can be freely selected and can be so positively controlled that it intensely impinges in the form of a jet upon the fuel so that a kind of resistance is imparted to the fuel flow without any fail thereby to precisely control the flow rate of the fuel.

The jet control type carburetor according to the present invention is constructed to comprise an intake pipe having an intake passage formed in an inner wall thereof, the intake passage allowing an intake air to flow therethrough; a venturi provided in the intake pipe, for controlling increasing flow velocity of the intake air in the intake passage to reduce pressure thereof; a fuel nozzle opened into the intake passage and connected to a fuel supply source through a fuel passage for sucking the fuel within the intake passage from the fuel nozzle in order to introduce the mixture of air and fuel within the intake passage; a throttle valve provided downstream of the venturi, for controlling the flow rate of the mixture of intake air and fuel; a control fluid nozzle opened into the intake passage and connected to a fluid supply source through a control fluid passage for jetting the flow of the control fluid to the fuel spurted from the fuel nozzle to afford the kinetic energy of the control fluid to the fuel; and a throttle means provided upstream of the control fluid nozzle in the control fluid passage, for controlling the flow rate of the control fluid. Hereinafter, a predetermined velocity component of the control fluid, having a contrary stream to that of the fuel spurted from the fuel nozzle, is called "kinetic energy" of the control fluid.

The jet control type carburetor having the aforementioned construction according to the present invention can enjoy the operational effect that the fuel flow rate and the mixing condition of the fuel and the air are controlled with high stability and response by the kinetic energy of the control fluid so that the exhaust gas purification and the fuel consumption are improved by controlling accurately the air-fuel ratio of the intake mixture.

In the jet control type carburetor thus constructed according to the present invention, more specifically, the control fluid injected from the fluid nozzle is made to directly impinge, with a sufficient penetration as a jet, upon the fuel to be introduced from its nozzle into the intake pipe, thereby to control the flow of the fuel so that the fuel flow rate can be precisely and efficiently controlled. In other words, a kind of resistance is imparted to the flow of the fuel by making the control fluid impinge upon the fuel so that the flow rate of the fuel can be controlled.

In more detail, the pressure difference between the discharge port of the fuel and a float chamber is varied by imparting to the fuel the total pressure of the control fluid in place of the static pressure, which is exerted upon the discharge port of the fuel, through the impingement of the control fluid, whereby the flow rate of the fuel is precisely controlled.

As a result, the carburetor according to the present invention can control the air-fuel ratio and the mixing condition between the intake air and the fuel with excellent stability and responsiveness.

By effecting the direct impingement of the control fluid upon the fuel at a position between the fuel nozzle and the control fluid nozzle, moreover, the mixing with the intake air can be remarkably finely and excellently, and the control relative thereto can be so simplified as to improve the reliability and durability and to simplify the construction of the system as a whole.

In fact, it has been confirmed by the experimental results conducted by the Inventors that the time fluctuation of the control fluid are sufficiently smaller than those of the additional air bleed for the aforementioned air bleed control.

According to the control system of the present invention, moreover, since the control of the fuel flow rate is accomplished in the intake pipe, the delay time in the response is shorter than that for the aforementioned air bleed control.

In the present invention, air, exhaust gases, hydrogen gases and the like may be used as a control fluid supplied from the fluid nozzle, while, as a fuel, propane gas is also used in addition to a fluid gas such as gasoline or the like.

According to a first aspect of the present invention, air is used as the control fluid, and there is disposed in the intake pipe a venturi, into which a fuel nozzle is opened. An air nozzle as a fluid nozzle is disposed to have its inlet port opened into the intake pipe upstream of the opening of the fuel nozzle or downstream thereof and upstream of the throttle valve and its outlet port opened in the vicinity of the opening of the aforementioned fuel nozzle so that a jet may be blown toward the opening of the fuel nozzle by the pressure difference in the intake passage which is equipped with the inlet and outlet ports of the air nozzle. By this kinetic energy thus imparted, the fuel flow rate is controlled so that the mixing ratio of the intake air and the fuel may be controlled.

In the jet control type carburetor thus constructed according to a first aspect of the present invention, the intake air flows through the venturi of the intake pipe so that the pressure in this venturi is dropped. As a result, the fuel is sucked and introduced through the opening of the fuel nozzle into the intake pipe. From the outlet port of the air nozzle, on the other hand, the air is sucked and introduced by the pressure difference between the venturi equipped with the outlet port of the air nozzle and the portion equipped with the aforementioned inlet port.

As a result, the air thus introduced impinges in the form of a jet upon the fuel coming from the fuel nozzle to impart a kind of resistance to the emanation of the fuel so that the flow rate of the fuel can be precisely controlled. According to this first aspect, since the pressure difference between the inlet and outlet ports of the air nozzle fluctuates in accordance with the running condition of the engine, the flow rate can be controlled in accordance with the engine running condition.

In the jet control type carburetor according to the second aspect of the present invention, air under pressure is used as the control fluid, and the fuel nozzle has its opening formed in the venturi of the intake pipe. And, an air nozzle communicating with a source of the pressurized air is also opened into the venturi. Moreover, a jet is injected toward the opening of the fuel nozzle so that the flow of the fuel is controlled by imparting the kinetic energy of the jet to the fuel thereby to control the mixing ratio between the intake air and the fuel.

In the jet control type carburetor thus constructed in accordance with the second aspect of the present invention, the intake air flows through the venturi of the intake pipe so that the pressure in the venturi is dropped. As a result, the fuel is sucked and introduced into the intake pipe through the opening of the fuel nozzle. On the other hand, air under pressure is supplied in the form of a jet from the air nozzle. As a result, this pressurized air can have its pressure freely selected and can be so positively controlled that it intensely impinges in the form of a jet upon the fuel spurting from the fuel nozzle so that a kind of resistance can be imparted to the flow of the fuel without any fail thereby to precisely control the flow rate of the fuel.

In the jet control type carburetor thus constructed according to the second aspect of the present invention, there can be achieved a merit that the pressure of the air can be freely set so that the control capacity can be freely selected. Therefore, the carburetor of the present invention can have a higher control capacity than that of the self suction type. The second aspect making use of the pressurized air as the control fluid can be applied not only to the aforementioned main system but also to the flow system in a similar manner to the first aspect such that it can be employed in the main and/or slow system.

Next, in the jet control type carburetor according to the first aspect of the present invention, the throttle means may be a variable throttle, which is disposed in a communication passage communicating the inlet and outlet ports of the air nozzle. By the action of this variable throttle, the flow rate of the jet flowing toward the fuel, which in turn flows into the intake pipe from the opening of the fuel nozzle, is so positively varied that fuel flow rate is controlled to control the mixing ratio between the intake air and the fuel.

In the jet control type carburetor thus constructed according to the first aspect of the present invention, the variable throttle is controlled to make variable the throttle opening area disposed in the communicating passage and accordingly the flow rate of the control air in accordance with the running condition, the air-fuel ratio, the contents of the exhaust gases and the like so that the ratio between the fuel flow rate through the fuel nozzle and the air flow rte through the air nozzle can be varied to desirably set and control the mixing ratio between the intake air and the fuel in accordance with the object. The operations of the aforementioned variable throttle as a throttle means may either have its effective area continuously variable or have the time ratio under the two open and closed position conditions successively varied. In the first aspect of the present invention, the flow rate of the control fluid can be partly controlled in a fine manner and the mixing ratio between the intake air and the fuel can be partly and desirably in a fine manner, even if the above-mentioned variable throttle is not used as a throttle means.

Next, the first aspect of the present invention can take the following four examples. In the carburetor according to a first example of the first aspect, air acting as the control fluid is injected from its air nozzle into the fuel which is discharged from the main nozzle opened into and communicating with the venturi. In This first example, the venturi may be a fixed venturi having a preset diameter. In the fixed venturi type carburetor according to the first example of the first aspect having the aforementioned construction, the intake air flows through the fixed venturi of the intake pipe so that the pressure in the fixed venturi is dropped. As a result, the fuel is sucked and introduced from the main nozzle through the opening thereof into the fixed venturi. On the other hand, air is sucked and introduced into the venturi from the outlet port of the air nozzle. As a result, this air impinges in the form of a jet upon the fuel spurting from the main nozzle to impart a kind of resistance to the fuel so that the flow rate of the fuel can be precisely controlled.

In this first example according to the first aspect of the present invention, the venturi may be a variable venturi having its diameter variable in a manner to correspond to the running condition of the engine. This variable venturi is equipped with a needle valve which is fitted to face the main nozzle. A jet is injected from the air nozzle toward the fuel spurting from the clearance between the main nozzle and the needle valve so that the fuel flow rate is controlled by imparting that kinetic energy to the fuel.

In the conventional carburetor, it is necessary to set the clearance between the needle valve and the main nozzle at about 10 microns during the idling operation, which invites quite difficulty in production so that fine control of the air-fuel ratio cannot be attained. However, in a carburetor of the first example according to the first aspect of the present invention, in which the jet is made to impinge upon the fuel thereby to reduce the fuel flow rate, the aforementioned clearance can be more than 100 microns to facilitate the production, and the fine and precise control of the air-fuel ratio can be attained by controlling the jet flow rate.

In still another concrete jet control type carburetor according to a second example of the first aspect of the present invention, there is opened into the venturi a first air nozzle which has its outlet port opened toward the opening of the main nozzle, and a second air nozzle has its outlet port opened downstream of the throttle valve so that the jet can be supplied. Moreover, the first- and second-named air nozzles have their inlet ports opened either upstream of the main nozzle or downstream up to the throttle valve, and the throttle means is disposed in the communication passage for the first and second air nozzles. Thus disposed throttle means is made operative to inject the jet from the first air nozzle into the fuel spurting from the aforementioned main nozzle into the intake pipe thereby to impart the kinetic energy to the fuel flow so that the flow rate of the fuel from the main nozzle may be controlled.

According to a first mode of the second example in the first aspect, moreover, the jet is fed from the second air nozzle to downstream of the throttle valve by the operations of the throttle means thereby to control the pressure fluctuations downstream of the throttle valve so that the flow rate of the fuel sucked and introduced from the aforementioned slow and idle ports into the intake pipe may be controlled, and during a low speed running operation having the main system inoperative a bypass flow as a jet is established, bypassing the throttle valve, by the actions of the control valve so that the intake mixture can be made lean by the increase in the flow rate of the intake air.

The jet control type carburetor thus far described is simple in construction as is different from the carburetors having a construction in which the jet impinging effects are imparted to the slow system, which will be described later.

Next, in the jet control type carburetor according to a third example of the first aspect of the present invention, the same jet control as that of the first aspect is applied to the slow system of the fixed venturi type carburetor. In the intake pipe for allowing the intake air to pass therethrough, there is disposed a venturi, into which the main nozzle is opened, and the slow port is opened into the vicinity of the mounting portion of the throttle valve so that the fuel may be mixed with the aforementioned intake air.

In the carburetor thus constructed, a fluid nozzle is arranged to have its opening formed in the vicinity of either or both of the openings of the aforementioned slow and idle ports, and there is disposed in the communication passage having communication with the fluid supply source at least one throttle means, by which the jet from the fluid nozzle is blown into the fuel spurting from the aforementioned slow and idle ports into the intake passage thereby to impart the kinetic energy to the fuel flow so that the fuel flow rate and accordingly the mixing ratio between the intake air and the fuel may be controlled. In this instance, it is understood that the inner circumference of the intake pipe and the restricted portion of the intake passage formed by the throttle valve play the same role as that of the venturi.

In the jet control type carburetor thus constructed according to the third example of the first aspect of the present invention, the control fluid to be supplied in the form of a jet from the fluid nozzle is made to directly impinge upon the fuel spurting into the intake pipe from the openings of the slow and idle ports thereby to control the flow of the fuel so that the flow rate of the fuel can be finely and efficiently controlled.

As a result, even during the low speed running operation of the engine, the air-fuel ratio can be controlled in the driving condition, under which no fuel is discharged from the main system so that the fuel control in the main system is impossible, so that the noxious gases can be prevented from being emitted during the low speed running operation while improving the fuel consumption rate.

Still another concrete jet control type carburetor according to a second mode of the second example of the first aspect in the present invention will be described in the following. In a carburetor of the type, in which a venturi is disposed in the intake pipe for allowing intake air to flow therethrough, in which a main nozzle is opened into the venturi and in which a slow port is opened in the vicinity of the mounting portion of the throttle valve so that the fuel may be mixed with the aforementioned intake air, a first fluid nozzle is opened in the vicinity of the opening of the aforementioned main nozzle, and a second fluid nozzle is opened in the vicinity of either or both of the openings of the aforementioned slow and idle ports.

Moreover, at least one throttle means is disposed in the communication passage for the first and second fluid nozzles communicating with a fluid supply source, and the jets from the first- and second-named fluid nozzles are injected into the fuel spurting from the aforementioned main nozzle, slow and idle ports by operating that throttle means thereby to impart the kinetic energy to the fuel flow so that the flow rate of the fuel is controlled to control the mixing ratio between the intake air and the fuel.

In the jet control type carburetor according to the second mode of the second example in the first aspect, since both the main and slow systems have controlling abilities, the air-fuel ratio can be finely controlled over the whole running range of the engine thereby to improve the drivability so that the noxious exhaust gases can be prevented from being emitted while improving the fuel consumption rate.

Next, still another concrete jet control type carburetor according to the fourth example of the first aspect in the present invention will be described in the following. According to this fourth example, the main nozzle of a main system fuel passage is opened into the venturi of an intake pipe, and the slow port of a flow system fuel passage is opened into the inner circumference of the intake pipe in the vicinity of the throttle valve. Just upstream of the slow port of the slow system fuel passage, there is formed an air chamber which is connected to the exit of the communication passage of control air, which is equipped with such a throttle means as is operative in accordance with the running condition of the engine.

In the opening of the main nozzle, on the other hand, there is disposed an air nozzle for injecting the air which is made to impinge upon the fuel sucked from the main nozzle by the vacuum in the intake air. To this air nozzle, there is connected the output of a communication passage for the control air, which is equipped with such a throttle means as is operative in accordance with the running condition of the engine whereby the flow rates of the fuel sucked from the aforementioned main nozzle and the fuel sucked from the aforementioned slow port are controlled by the impinging force of the air injected from the air nozzle and the air pressure in the air chamber, respectively.

In the main nozzle of the carburetor thus constructed according to the fourth example, the jet injected from the air nozzle thereof is made to impinge upon the fuel sucked from the main nozzle by the vacuum pressure in the intake pipe so that the suction of the fuel is controlled by the impinging force of the air injected from the air nozzle. In the slow port having the air chamber, on the other hand, the fuel flow rate is controlled by controlling the air pressure in the air chamber and the flow rate of the control fluid through the actuation of the aforementioned control valve. As is different from the conventional carburetor of the type, in which air is additionally mixed into the fuel under an emulsion condition, therefore, no pulsation takes place in the fuel, which is sucked from the main nozzle or the slow port, so that the air-fuel ratio of the mixture can be precisely controlled. As a result, there take place neither the fluctuations in the engine output, the deterioration in the driviability nor the emission of the noxious contents in the engine exhaust gases due to the fluctuations in the air-fuel ratio of the mixture.

Moreover, the construction can be simplified by controlling the slow system in accordance with the air pressure in the air chamber.

In another carburetor according to the second aspect of the present invention, the throttle means may be a fixed throttle, which is disposed in the communication passage communicating the opening of the air nozzle and the source of the pressurized air thereby to adjust the jet from the air nozzle so that the flow rate of the fuel spurting from the opening of the fuel nozzle into the intake pipe is controlled by the jet from the aforementioned air nozzle thereby to control the mixing ratio between the intake air and the fuel.

In the jet control type carburetor thus constructed, by adjusting and controlling the jet from the air nozzle through the fixed throttle, the ratio between the fuel flow rate through the fuel nozzle and the air flow rate through the air nozzle can be determined at a preset value, and the mixing ratio between the intake air and the fuel can be set and controlled at such a preset value as is suitable for the running condition.

On the other hand, still another jet control type carburetor according to the second aspect of the present invention is so constructed that the throttle means may be a variable throttle, which is disposed in the communication passage for providing communication between the opening of the aforementioned air nozzle and the source of the pressurized air.

With the operations of this variable throttle as the throttle means, the flow rate of the fuel spurting from the opening of the fuel nozzle into the intake pipe is controlled by the jet which is injected toward the fuel from the air nozzle so that the mixing ratio between the intake air and the fuel can be controlled. Since, moreover, the jet is controlled, the mixing ratio inbetween can be finely controlled to suit the running condition.

In the jet control type carburetor according to the second aspect of the present invention, since the pressure in the pressurized air can be freely set, there can be attained a merit that the controlling ability can be freely selected to a higher value than that of the self-suction type carburetor according to the first aspect of the present invention. The second aspect making use of the pressurized air as the control air may be applied not only to the aforementioned main system but also to the slow system in a similar manner to the first aspect so that it can be used in the main and/or slow system.

In a further jet control type carburetor according to a first example of the second aspect of the present invention, the main nozzle of a main system fuel passage is opened into the venturi of an intake passage, and both the idle port and the slow port of the slow system fuel passage are opened in the vicinity of the throttle valve of the intake air passage. Moreover, there is connected to the outlet port of a control air passage an air nozzle from which air is injected to impinge upon the fuel sucked from the main nozzle, the slow port or the idle port by the vacuum in the intake air passage. With the inlet port of the control air passage, still moreover, there is connected an air pump a source of the pressurized air which functions to control the discharge pressure and flow rate in accordance with the running condition of the engine.

In the carburetor thus constructed, the air injected from the air nozzle is made to impinge upon the fuel sucked from the main nozzle or the slow or idle port, and the discharge pressure and flow rate of the air pump for supplying the air with the air nozzle are increased and decreased in accordance with the running condition of the engine.

Thus, since flow rate of the fuel from the main nozzle or the slow or idle port is controlled by the variation in the impinging force of the air injected from the air nozzle, there is established no pulsation in the fuel spurting from the main nozzle or the slow or idle port, as is quite different from the conventional carburetor, in which air is additionally mixed into the fuel under the emulsion condition flowing through the fuel passage, so that the quantity of the spurting fuel can be precisely controlled, which in turn controls the air-fuel ratio of the mixture in a precise manner.

As a result, there take place neither the fluctuations in the engine output, the deterioration in the drivability nor the emission of the noxious contents in the engine exhaust gases due to the fluctuations in the air-fuel ratio of the mixture.

Still moreover, the jet control type carburetor according to a second example of the second aspect of the present invention is constructed such that an air nozzle is arranged to face the aforementioned main nozzle and to have communication with a source of pressurized air through a communication passage and that a variable throttle as the throttle means is disposed in the communication passage. By the operations of this variable throttle, the flow rate of the fuel to spurt from the opening of the fuel nozzle into the intake pipe is controlled by the jet injected toward it from the air nozzle so that the mixing ratio between the intake air and the fuel can be controlled. Since, moreover, the jet itself is controlled by the variable throttle, the mixing ratio between the intake air and the fuel can be finely controlled to suit the running condition.

On the other hand, a first mode of the second example of the second aspect in the present invention is directed to a carburetor which is applied to such an engine as is equipped with a secondary air supply system for improving the combustion or the catalyst cleaning efficiency. More specifically, an air nozzle is opened into the venturi while facing the main nozzle. This air nozzle is made to have communication with a source of secondary air through a control valve.

According to the jet control type carburetor thus constructed, since the control air is pressurized secondary air, it is intensely injected from the air nozzle into the main nozzle the fuel flow rate from the main nozzle can be the more precisely and responsively controlled. At the cold start, no control air is injected so that the smooth running operation may be performed with a rich mixture, and the secondary air is supplied to prepare such a mixture as is suitable for the catalyst in the engine exhaust gases. During the warmed-up hot operation, on the other hand, the control air is injected to prepare such a proper mixture as to smoothen the drivability and to improve the fuel consumption rate not only during the warmed-up but also during a high speed running operation.

On the other hand, the jet control type carburetor according to a second mode of the second example in the second aspect of the present invention is constructed such that an air nozzle is opened to face the slow port in addition to the main nozzle of the aforementioned carburetor and that the air nozzle is made to have communication with a source of secondary air as the source of the pressurized air through a throttle means.

In the carburetor thus constructed, since the control air is pressurized secondary air, it is intensely injected toward the slow port so that the fuel flow rate from the slow port can be controlled. In addition to the effect obtainable in case only the aforementioned main nozzle is provided, the carburetor under consideration can exhibit the effect that the slow system can also be controlled.

Next, the following fluid may be also employed in addition to air as a control fluid according to the present invention.

A further concrete jet control type carburetor of the present invention, in which an exhaust gas is used as a control fluid, is constructed such that an exhaust gas nozzle is opened to face the slow port in addition to the main nozzle of the aforementioned carburetor and that the exhaust gas nozzle is made to have communication through a throttle means with an exhaust gas recirculation passage having communication with an exhaust pipe as a source of control fluid.

According to the carburetor thus constructed, the exhaust gases are intensely injected from the exhaust gas nozzle toward the main nozzle thereby to properly control the fuel flow rate from the main nozzle and to partly promote the evaporation with the exhaust gases and partly improve the purification of the exhaust gases. The carburetor under discussion can exhibit its effect more in the slow speed running range than those of the foregoing carburetors.

Next, a further jet control type carburetor of the present invention uses a hydrogen gas as a control fluid. Namely, it is applied to the case, in which additional hydrogen gases is supplied to the fuel. More specifically, the carburetor is constructed such that a hydrogen gas nozzle is opened into the venturi in a manner to face the main nozzle and is connected with a source of hydrogen gases as a source of control fluid through a throttle means.

According to the carburetor thus constructed, since the hydrogen gases are used as the control fluid, they are injected from their nozzle toward the main nozzle so that the fuel flow rate from the main nozzle can be precisely controlled, while ensuring the lean combustion with the addition of the hydrogen gases, thereby to reduce the cost for the fuel and to improve the purification of the exhaust gases.

On the other hand, a further jet control type carburetor according to the present invention is so constructed that the hydrogen gas nozzle is opened to face the slow port in addition of the main nozzle of the aforementioned carburetor and that the hydrogen gas nozzle is connected with the hydrogen gas source as a source of control fluid through a throttle means. Thus, the hydrogen gases are injected as jets toward the fuels in the main nozzle and the slow port so that the kinetic energy may be imparted thereto, thus making it possible to precisely control the aforementioned fuel flow rate. In addition to those operational effects of the foregoing carburetors, the carburetor under discussion can exhibit its effect even in the slow speed running range.

Next, a still further jet control type carburetor according to the present invention is applied to a double main nozzle type one, which is constructed such that both a lean mixture preparing main system fuel passage as a first main nozzle for supplying a fuel in a quantity short of the proper one of the main system fuel and an air-fuel ratio controlling main system fuel passage as a second main nozzle for supplying a quantity in a quantity according to the running condition of the engine are opened into the venturi of the intake air passage and that a control liquid passage equipped with a throttle means has its outlet port opened to face the latter main system fuel passage for controlling the air-fuel ratio. An air nozzle is opened to face the first main nozzle to impart the kinetic energy to the fuel from the first main nozzle.

According to the carburetor thus constructed, a mixture suitable for the running condition can be prepared by controlling the flow rate of the control fluid through the operations of the control valve.

BRIEF DESCRIPTION OF THE DRAWINGS

Various other objects, features and attendant advantages of the present invention, will be more fully appreciated as the same becomes better understood from the following detailed description when considered in connection with the accompanying drawings in which like reference characters designate like or corresponding parts throughout the several views, and wherein:

FIGS. 38 and 39 are respectively a shematic view and a partially enlarged section showing the carburetor according to a thirteenth embodiment of the present invention;

FIG. 54 is a schematic view showing the carburetor according to a twenty fourth embodiment of the present invention.

DETAILED DESCRIPTION OF THE PREFERRED EMBODIMENTS

Figure 1:
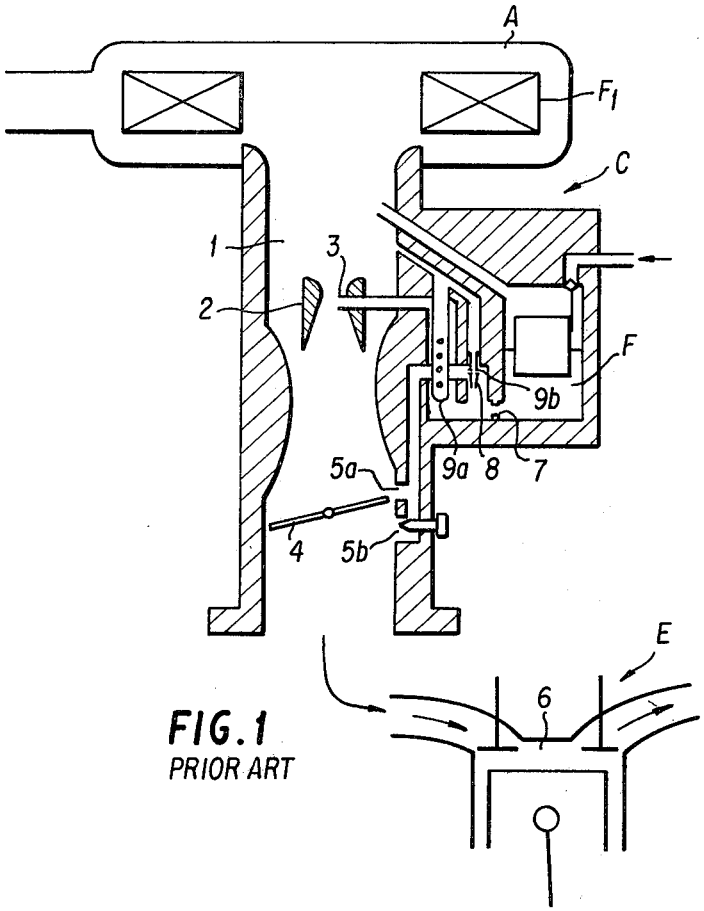
FIG. 1 PRIOR ART
FIG. 1 is a longitudinal section showing a carburetor according to the prior art.
Figure 2:
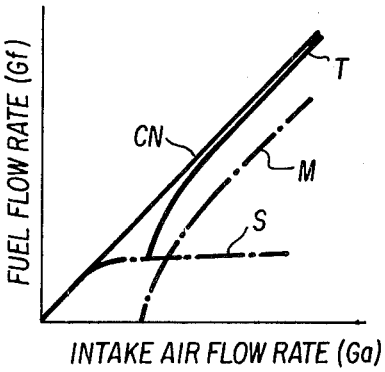
FIGS. 2 and 3 respectively show diagrammatical views showing the operating conditions of the carburetor according to the prior art.
Figure 3:
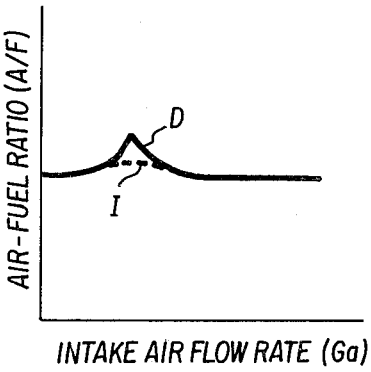
Figure 4:
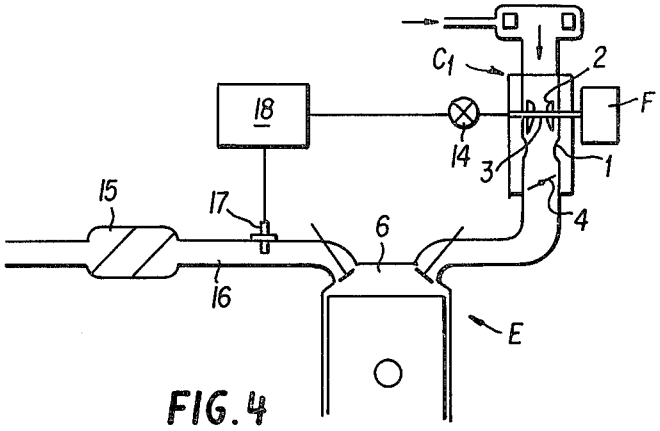
FIG. 4 is a longitudinal section showing a jet control type carburetor according to a first embodiment of the present invention.
Figure 5:
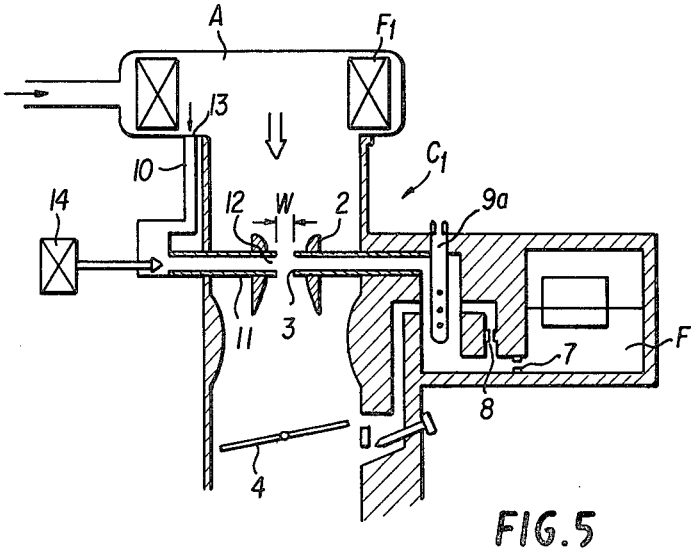
FIG. 5 is an enlarged longitudinal section showing the jet control type carburetor according to the first embodiment.

The respective embodiments of the present invention will now be described in detail with reference to the drawings.

A first embodiment of the present invention is directed to a fixed venturi type carburetor. This first embodiment belongs to the first example of the first aspect of the present invention, which is applied to a double venturi type carburetor $C_1$, as shown in FIGS. 4 to 8. The fuel under an emulsion condition, which is sucked and fed through such a main nozzle 3 as is opened into the smaller venturi 2 of the double venturi arranged in an intake pipe 1, is mixed into the intake air flowing through the intake pipe 1 thereby to prepare an air-fuel mixture, which is supplied to a combustion chamber 6. The main nozzle 3 has its upstream communicating with a float chamber F through an air bleed 9*a* and a main jet 7.

Here, in the carburetor $C_1$ of this first embodiment, an air nozzle 11 having communication with a control fluid passage 10 is arranged in the smaller venturi 2 in a manner to face the opening of the aforementioned main nozzle 3 so that the control fluid can be sucked and fed. The control fluid passage 10 has its inlet port 13 opened downstream of the filter $F_1$ of an air cleaner A. The throttle means is a variable throttle comprising a throttle portion and a control portion. There is disposed in the control fluid passage 10 throttle portion controlled by an actuator 14 of the throttle means for controlling the air-fuel ratio. This actuator 14 of the variable throttle means is electrically connected through a controller 18 to an oxygen sensor 17 which is arranged to face exhaust gases in an exhaust pipe 16 as has communication with the combustion chamber 6 and as has its downstream connected to a three-way catalyst device 15 thereby to constitute a closed loop control system, whereby the air-fuel ratio of the carburetor $C_1$ is controlled to the most proper stoichiometric level. The opening of the aforementioned main nozzle 3 is made to have substantially the same diameter as that of the outlet port of the control fluid passage 10.

According to the carburetor $C_1$ of the first embodiment having the construction thus far described, if the oxygen concentration in the exhaust gases is found low (i.e. the air-fuel ratio of the intake mixture being in rich) by means of the oxygen sensor 17 opened into the exhaust pipe 16, the output signal relating thereto is fed through the controller 18 to turn on the actuator 14 to jet the control fluid toward the fuel nozzle from the exit port 12 of the control fluid passage 10, thereby to impinge the control fluid (air jet) upon the fuel to suppress the flow rate of the fuel. As a result, the intake air and the fuel are not influenced by the control fluid but perform their intrinsic control of the air-fuel ratio so that this ratio is shifted from rich to lean sides to promptly restore its stoichiometric value.

If, on the other hand, the oxygen concentration in the exhaust gases is high (i.e., the air-fuel ratio of the intake mixture being in lean) the relating output signal is fed through the controller 18 to the actuator 14 to bring this actuator 14 into its closed condition so that the supply of the control fluid from the exit port 12 of the control fluid passage 10 is blocked. As a result, the ratio between the intake air and the fuel is shifted from lean to rich sides to promptly restore its stoichiometric value.

Figure 6:
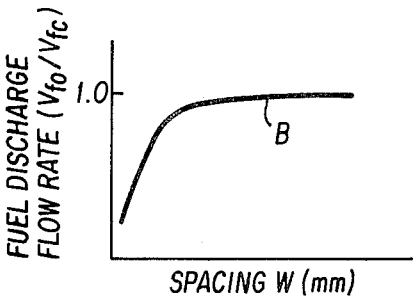
FIG. 6 is a graphical presentation comparing the fuel discharge flow rate and the spacing.

FIG. 6 shows a graphical presentation comparing the fuel discharge flow rate (Vfo/Vfc) as shown in the ordinate and a predetermined spacing (W) between the exit port 12 of the control fluid passage and the main nozzle as shown in the abscissa. Here, if the fuel discharge flow rate in the carburetor $C_1$ is denoted at $V_{fo}$ for the operation of the actuator 14 (open) and at $V_{fc}$ for the inoperation (close) of the same, the ratio inbetween has such a tendency as is shown in curve B of FIG. 6, wherein $(V_{fo}/V_{fc})=1.0$ means that the fuel flow rate is not reduced even if the actuator of a throttle means is opened. The actuator is opened when $V_{fo}/V_{fc}$ is smaller than 1.0 thereby to obtain the control effect of the fuel flow rate. At this time, the fuel discharge flow rate $V_{fo}$ for the operation of the actuator 14 is remarkably varied by changing the spacing W between the exit port 12 of the control fluid passage 10 and the main nozzle 3. By selecting the value of the aforementioned spacing W at a preset size, therefore, the air-fuel ratio can be varied over a remarkably wide range, thus providing a highly practical effect. In this case, little change of intake air flow rate has been found between the operation and inoperation of the actuator 14. By forming the exit port in the smaller venturi 2, moreover, no reduction in the sucking and extracting ability of the fuel at the main nozzle 3 has been found. As a result, by setting the predetermined spacing W between the exit port 12 and the main nozzle 3 at a preset value and by effecting the control through the operation and inoperation of the actuator 14, the carburetor $C_1$ according to the first embodiment can enjoy the effect that the air-fuel ratio control can be made meanly stable and satisfactory.

Figure 7:
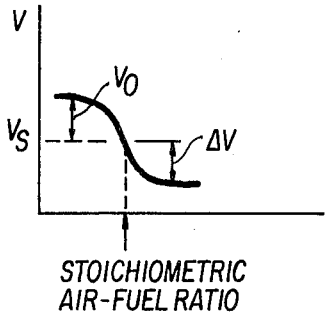
FIG. 7 is a graphical presentation showing the electromotive force variations of an oxygen sensor.
Figure 8:
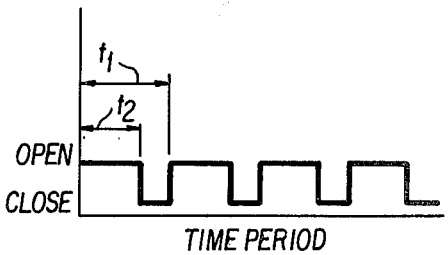
FIG. 8 is a graph showing the operations of the actuator.

In the carburetor $C_1$ of the first embodiment, moreover, since the output, i.e., the electromotive force $V_o$ of the oxygen sensor 17 for controlling the operations of the actuator 14 is markedly varied about the stoichiometric ratio (shown in a broken line), as shown in FIG. 7, the difference of the electromotive force from that of the instant of the stoichiometric ratio is used to change the operating time period of the actuator 14. As a result, when the mixture is at its lean side, since the difference between the output of the oxygen sensor 17 and the reference electromotive force $V_s$ at the stoichiometric ratio is negative as shown in $\Delta V$, the time ratio $t_2/t_1$ for rendering the actuator 14 inconductive is reduced at the output of the controller 18 (as shown in FIG. 8). Thus, the time period, for which the control fluid is injected from the exit port 12, is shortened to increase the discharge of the fuel so that the air-fuel ratio can be varied to its rich side without fail.

According to the first embodiment, therefore, since there takes place no direct change in the emulsion flow in the main nozzle 3, difficulties such as pulsations in the fuel are not experienced with the resultant practical effects that the control of the mixture concentration can be made precise and that the reliability can be enhanced.

Incidentally, although the air bleed **9*a*** is indispensable in the first embodiment thus far described, the present invention should not be limited thereto but can be effectively practised in a (not-shown) carburetor which is not equipped with such air bleed.

According to this modification, any pulsations in the fuel discharge due to the provision of the air bleed can be wholly eliminated to invite the practical effects that the control and operation can be improved and that the construction can be simplified while reducing the production cost.

Figure 9:
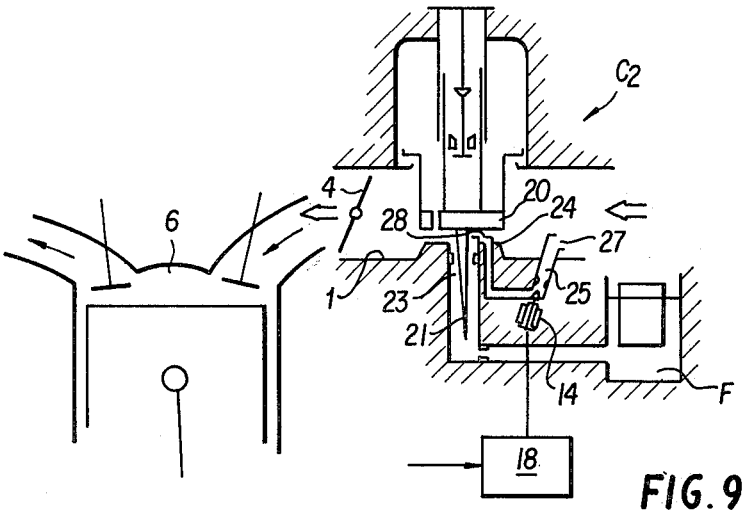
FIG. 9 is a longitudinal section showing the jet control type carburetor according to a second embodiment of the present invention.

A second embodiment of the present invention is directed to the example, in which the first example of the first aspect of the present invention is applied to the so-called SU carburetor $C_2$ equipped with a variable venturi 20, as shown in FIG. 9. There is mixed into the intake air flowing through an intake pipe 1 the fuel which is sucked and fed out through such a main nozzle 23 as has its opening facing the variable venturi 20 and has a movable needle 21 fitted therein, thereby to prepare a mixture of a preset air-fuel ratio, which is fed to a combustion chamber 6. This venturi 20 is made movable back and forth within the intake pipe 1 in accordance with the various running conditions of the (not-shown) engine so that the needle 21 is accordingly moved to change the effective area of the main nozzle 23 thereby to control the discharge of the fuel.

Here, the carburetor $C_2$ according to the second embodiment is constructed such that a control fluid passage 25 has its inlet port 27 opened upstream of the variable venturi 20 and a control fluid nozzle 24 corresponding to an exit or outlet port 28 of the control fluid passage 25 is opened to face the opening of the main nozzle 23 at the stationary side of the variable venturi 20.

As a result, according to the carburetor $C_2$ of the second embodiment, the control fluid is discharged from the exit port 28 of the control fluid passage 25 toward the main nozzle 23 during the operation of the actuator 14 as the control portion of the throttle means so that it impinges upon the fuel to depress the fuel to be sucked and fed out. Thus, the carburetor $C_2$ of the second embodiment can enjoy the operational effect that the fuel flow rate can be precisely and excellently responsively in addition to the similar effects to those of the aforementioned embodiments.

Figure 10:
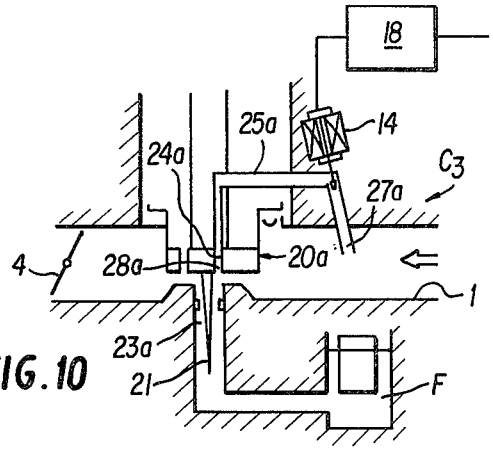
FIG. 10 is a longitudinal section showing the jet control type carburetor according to a third embodiment of the present invention.

On the other hand, a third embodiment of the present invention is directed to the example, in which the present invention is applied to the SU carburetor $C_3$ in a similar manner to the aformentioned second embodiment, as shown in FIG. 10. However, the carburetor $C_3$ of the third embodiment is different from that of the second embodiment in that a control fluid nozzle **24*a* having communication with a control fluid passage 25*a* is disposed at the vacuum piston of a variable venturi 20*a*, that the control fluid passage 25*a* has its inlet port 27*a* opened upstream of the variable venturi 20*a* and its exit port 28*a* corresponding to the control fluid nozzle 24 which is opened to face a main nozzle 23*a*, and that the clearance between the opening of the outlet port 28*a* and the opening of the main nozzle 23*a*** is made variable.

As compared with the second embodiment, therefore, the carburetor $C_3$ of the third embodiment responds to the operation of the variable venturi 20*a* so that it can discharge the control fluid from a preset position toward the main nozzle 23*a*. Thus, the carburetor $C_3$ of the third embodiment can enjoy the operational effect that the fuel flow rate can be controlled to a satisfactory extent in addition to the similar effects to those of the aforementioned embodiments.

Next, the aforementioned fixed venturi type carburetor according to the first embodiment of the present invention is divided into the type, in which the main nozzle and the air nozzle at the venturi are arranged to face each other, and into the other type in which the main nozzle and the air nozzle are arranged in the same direction. In either type, a jet is blown from the air nozzle into the fuel spurting from the main nozzle thereby to impart the kinetic energy to the fuel so that the fuel flow rate can be presisely controlled.

In a concrete carburetor belonging to the former type, a hollow cylindrical main nozzle and an air nozzle are disposed to have their open ends facing the inside of the venturi, and those main nozzle and the air nozzle are arranged to face each other at a preset spacing inbetween so that the jet from the air nozzle is blown into the fuel spurting from the main nozzle thereby to impart the kinetic energy to the fuel flow.

In a further concrete carburetor belonging to the former type, a hollow cylindrical body is mounted in the venturi in the axial direction and in a manner to cross the axis, and the cylindrical body is equipped in its inside with a communication passage and is formed with a plurality of small pores having communications with the inside of the venturi. The cylindrical body has its one end communicating as the main nozzle with a source of fuel and its other end communicating as the air nozzle with a source of air.

Thus, the air jet is made to directly impinge upon the fuel inside of the communication passage to impart the kinetic energy to the latter so that the fuel flow rate is controlled. After this control, the fuel can be sucked and introduced into the venturi through the plural pores.

Incidentally, the carburetor thus described is not limited thereto but can be modified such that a hollow cylindrical main nozzle having its leading end closed is disposed in the venturi in the diametrical direction thereof and in a manner to cross the axis and is equipped in its inside with a communication passage.

Moreover, this main nozzle is formed with a plurality of small pores having communications with the inside of the venturi. An air nozzle having a smaller diameter is fitted in an overlapped manner in the main nozzle at a preset ratio while leaving a preset clearance inbetween. The aforementioned main nozzle is made to have communication with a source of fuel whereas the air nozzle is made to have communication with a source of air. Thus, the air jet is brought into direct impingement upon the fuel within the aforementioned communication passage and in the clearance thereby to impart the kinetic energy to the fuel so that the fuel flow rate is controlled. After this control, the fuel may be sucked and introduced into the venturi through the plural small pores.

According to the carburetor thus constructed, since the impingement of the air jet with the fuel takes place inside of the communication passage, the impinging effect of the air jet is not weakened by the intake air so that a wide controllability can be attained. Moreover, the experiments conducted by the Inventors have revealed that the atomization and distribution of the fuel are so excellent that the drivability can be improved while preventing emission of the noxious gases.

In another concrete carburetor, a hollow cylindrical body is disposed in the venturi and is equipped in its inside with a communication passage. This cylindrical body is further formed with a notch having communication with the inside of the venturi. One end of the cylindrical body is made to have communication as a main nozzle with a source of fuel whereas the other end thereof is made to have communication as an air nozzle with a source of air. Thus, the air jet is made to directly impinge upon the fuel within the notch or the communication passage so that the kinetic energy is imparted to the fuel thereby to control the fuel flow rate. After that, the fuel can be sucked and introduced into the venturi through that notch.

According to the carburetor thus constructed, since the impingement of the air jet with the fuel takes place inside of the communication passage, the impinging effect of the air jet is not weakened by the intake air so that a wide controllability can be attained. Moreover, the construction is so simplified that the carburetor can be produced with ease.

Incidentally, the aforementioned carburetor should not be limited thereto but can be modified such that a hollow cylindrical main nozzle having its leading end closed is disposed in the venturi in the radial direction and in a manner to cross the axis. This main nozzle is equipped in its inside with a communication passage and is formed with a notch having communication with the inside of the venturi. There is fitted in a manner to overlap at a preset ratio in that main nozzle an air nozzle which has a smaller diameter than the main nozzle. A preset clearance is held between the main nozzle and the air nozzle. The aforementioned main nozzle is made to have communication with a source of fuel whereas the air nozzle is made to have communication with a source of air. Thus, in the aforementioned communication passage and clearance, the air jet is made to directly impinge upon the fuel thereby to impart the kinetic energy to the fuel so that the fuel flow rate is controlled. After that, the fuel can be sucked and introduced into the venturi through that notch.

In a further modification, a main nozzle formed at its leading end with a notched opening and an air nozzle formed at its leading end with an opening are made to abut against each other within the venturi so that they are integrally connected while being disposed in the radial direction of the venturi and in a manner to cross the axis.

In a further concrete carburetor, on the other hand, a main nozzle and an air nozzle both having a hollow cylindrical shape are arranged to have their open ends facing the inside of the venturi and to face each other uniaxially at a preset spacing. Just above the main and air nozzles, there is disposed a member for promoting the mixing between the fuel and the intake air, which is arranged in the radial direction of the venturi and in a manner to cross the axis. Just below the mixing promoting member, the jet from the air nozzle is blown into the fuel spurting from the main nozzle so that the fuel flow rate is controlled through the application of the kinetic energy.

In the carburetor thus constructed, since the jet from the air nozzle flows into the separation (recirculation)

region which is established behind the mixing promoting member, less influences are received from the intake air coming from the upstream of the intake pipe. As a result, the control air coming from the air nozzle can have such high penetration ability that it can impinge upon the fuel from the main nozzle without fail thereby to highly accurately control the fuel flow rate. In the carburetor thus constructed, moreover, since the fuel is discharged into the separation region, the mixing with the intake air is so promoted as to have excellent distributions among engine cylinders. The aforementioned mixing promoting member may have not only a circular cross-section but also arcuate, planar and bent cross-section.

In the concrete carburetor belonging to the latter type i.e. the same direction type, a main nozzle is disposed to have its opening facing the inside of the venturi. There is mounted coaxially around the main nozzle an air nozzle, which has a larger diameter than the main nozzle, such that a preset clearance is formed inbetween to provide a dual pipe structure. The aforementioned air nozzle has its leading end protruding from the open end of the main nozzle in a tapered manner and formed in its inside with a communication portion for providing communication between the control air and the fuel. Thus, the air jet is blown into the fuel from the main nozzle so that the fuel flow rate is controlled through the application of the kinetic energy.

In the carburetor thus constructed, the air jet which is throttled at the aformentioned communication portion and injected from the air nozzle is made to impinge upon thhe fuel, which is sucked and introduced into the venturi from the opening of the main nozzle so that the fuel flow rate can be controlled to a satisfactory extent through the application of a kind of resistance. This carburetor is especially effective in case the air nozzle cannot be arranged in a position to face the main nozzle from the constructional restriction so that it can prevent the wall surface from being wetted with the fuel.

Figure 11:
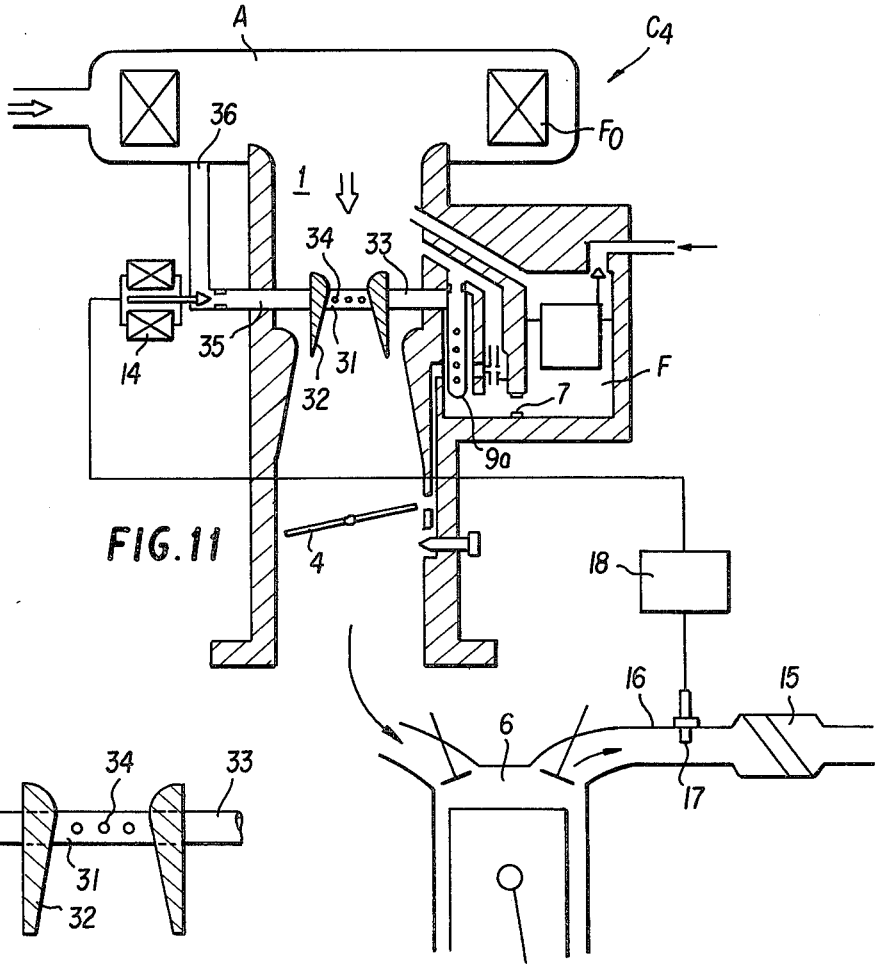
FIGS. 11 and 12 are respectively a longitudinal section and a partially enlarged transverse section showing the jet control type carburetor according to a fourth embodiment of the present invention.
Figure 12:
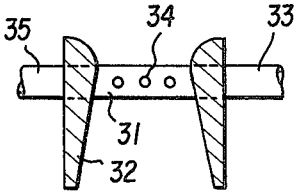

In the carburetor $C_4$ of the fourth embodiment belonging to the first example of the first aspect in the present invention, as shown in FIGS. 11 and 12, the fuel which is sucked and fed out into the intake pipe 1 through a plurality of small pores 34 of a tube means as a main nozzle 33 which is mounted in the smaller venturi 32 of the double venturi is mixed into the intake air flowing through the intake pipe 31 from the air cleaner A. Thus, a mixture having a preset air-fuel ratio is prepared and fed to the combustion chamber 6. The main nozzle 33 has its upstream communicating with the float chamber F through the air bleed 9*a* and the main jet 7.

In the carburetor $C_4$ according to this fourth embodiment, it should be noted that a control fluid passage 35 having an outlet side corresponding to a control fluid nozzle 31 is made to have substantially the same diameter as that of the main nozzle 33 and is arranged coaxially within the smaller venturi 32 in a manner to face and communicate with the main nozzle 33 so that the control fluid can be sucked and fed out. Within the communicating portion between the main nozzle 33 and the control fluid nozzle 31 having communication with the control fluid passage 35, the control fluid is made to directly impinge upon the fuel so that the fuel flow rate may be controlled in accordance with the flow rate of the control fluid. After that, the fuel can be sucked and fed out into the smaller venturi 32 through the plurality of the small pores 34 of the tube means. The control fluid passage 35 has its inlet port 36 opened downstream of the filter $F_0$ of the air cleaner A. The control fluid passage 35 is equipped with the variable throttle means comprising a throttle and control portions for controlling the air-fuel ratio. The actuator 14 as the control portion of the throttle means is electrically connected through the controller 18 with the oxygen sensor 17, which is arranged to face the exhaust pipe 16, thus constituting a closed loop control system. The exhaust pipe 16 has its upstream communicating with the combustion chamber 6 and its downstream connected with the tertiary catalyst device 15. Thus, the air-fuel ratio of the carburetor $C_4$ according to this fourth embodiment is controlled to the most proper stoichiometric ratio.

In addition to substantially the same operational effects as those of the aforementioned respective embodiments, the carburetor $C_4$ thus constructed according to the fourth embodiment can enjoy the practical effect that, since there is no direct change in the emulsion flow in the main nozzle 33, the concentration of the mixture can be precisely controlled with enhanced reliability but without inviting the difficulty such as the pulsations in the fuel.

According to the carburetor $C_4$ of the fourth embodiment, moreover, the control fluid is not influenced by the intake air flowing through the intake pipe 1 so that the jet penetration ability of the control fluid can be made high enough to effectively reduce the fuel discharge flow rate during the operation of the actuator 14 with the resultant practical effect that the air-fuel ratio can be freely controlled.

Figure 13:
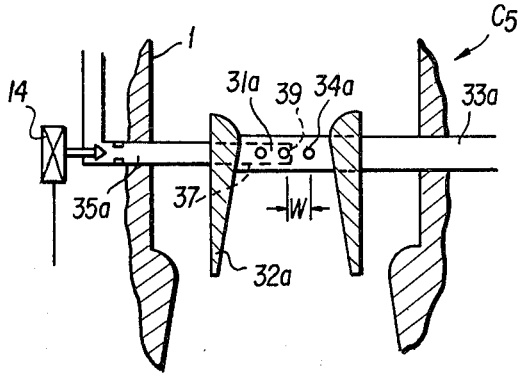
FIGS. 13 and 14 are respectively a longitudinal section and a partially enlarged transverse section showing the jet control type carburetor according to a fifth embodiment of the present invention.
Figure 14:
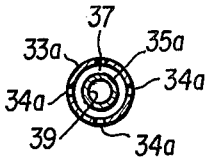

Next, in the carburetor $C_5$ of the fifth embodiment belonging to the first example of the first aspect in the present invention, as shown in FIGS. 13 and 14, a control fluid passage 35*a* is fitted in a main nozzle 33*a* at its outlet side corresponding to a control fluid nozzle 31*a*, as is different from the aforementioned fourth embodiment. In the carburetor $C_5$ according to the fifth embodiment, more specifically, the main nozzle 33*a* is mounted in the smaller venturi 32*a* and is inserted in the main nozzle 33*a* at its outlet side in a manner to form a preset radial clearance 37. The spacing W between the exit port 39 of the control fluid nozzle and the pores 34*a* of the main nozzle 33*a* is set at a predetermined value. The remainder is substantially the same as those of the aforementioned fourth embodiment, and as such being the case the like portions are indicated at the same characters so that their repeated explanations are omitted here.

In the carburetor $C_5$ thus constructed according to the fifth embodiment, the fuel to be sucked and fed out into the smaller venturi 32*a* from the inside of the main nozzle 33*a* through the plurality of the small pores 34*a* is subjected to the more direct attack than that of the aforementioned fourth embodiment by the jet of the control fluid, which is discharged in the axial direction from the exit or outlet port 39 of the control fluid passage 35*a* so that the fuel flow rate can be reduced the more satisfactorily.

In the carburetor $C_5$ of the fifth embodiment, the fuel discharge during the operation of the actuator 14 can be remarkably changed by changing the spacing W between the exit port 39 of the control fluid passage 38 and the main nozzle 33*a*. Thus, such a practical effect can be attained that the fuel discharge can be varied over a remarkably wide range of the air-fuel ratio by selecting the spacing W at the preset size. In addition, substantially the same operational effects as those of the aforementioned fourth embodiment can also be attained.

Figure 15:
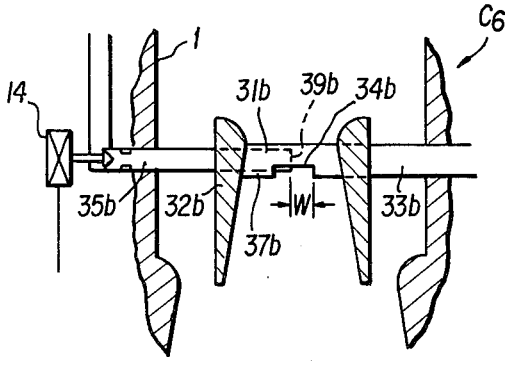
FIGS. 15 to 17 are respectively sectional views showing in an enlarged scale the venturi of the jet control type carburetor according to a sixth embodiment of the present invention.
Figure 16:
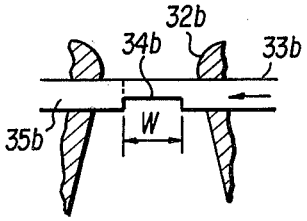
Figure 17:
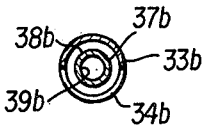

In a carburetor $C_6$ according to the sixth embodiment of the present invention, which belongs to the first example of the first aspect in the present invention. As shown in FIGS. 15 to 17, there are differences from the foregoing respective embodiments in that a main nozzle 33*b* comprising a tube means mounted in the smaller venturi 32*b* is formed with a notched opening 34*b*, from which the fuel is sucked and fed out, and that a control fluid passage 35*b* having a smaller diameter is fitted in the main nozzle 33*b* at its outlet side corresponding to a control fluid nozzle 31*b* in a manner to leave a preset radial clearance 37*b* inbetween. In the control fluid passage 35*b*, moreover, the clearance W of a preset value is formed between the exit port 39*b* of the passage 35*b* and one end of the notched opening 34*b* of the main nozzle 33*b*.

In the carburetor $C_6$ thus constructed according to the sixth embodiment, the fuel to be sucked and fed out into the smaller venturi 32*b* from the inside of the main nozzle 33*b* through the notched opening 34*b* is subjected to the direct attack by the jet of the control fluid, which is discharged in the axial direction from the exit port 39*b* of the control fluid passage 38*b*, so that the fluid flow rate can be reduced by the application of a kind of flow resistance.

According to the carburetor $C_6$ of the sixth embodiment, moreover, since the control fluid flows as a jet into the separation region which is established behind the notched opening 34*b* of the main nozzle 33*b*, it receives less influences from the intake air flowing from the upstream. Thus, since the control fluid can have a remarkably high jet penetration ability, it can impinge upon the fuel, even if the spacing between the main nozzle 33*b* and the exit port 39*b* of the control fluid passage 38*b* is larged, so that it can control the fuel flow rate without fail.

Thus, there can be attained the practical effect that the air fuel ration can be widely changed in addition to substantially the same operational effects to those of the aforementioned respective embodiments.

In the carburetor $C_6$ of the sixth embodiment, incidentally, it is possible to modify in such a construction that the main nozzle 33*b* having the notched opening 34*b* and the control fluid passage 35*b* are arranged to axially face each other while having substantially the same diameter and to have communication with each other, as shown in FIG. 16. Thus, in addition to substantially the same operational effects to those of the aforementioned carburetor $C_6$ of the sixth embodiment, it is possible according to the above modification to attain the effect that the production can be facilitated.

Figure 18:
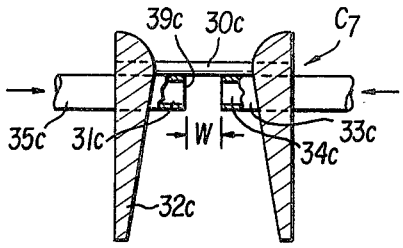
FIGS. 18 and 19 are respectively sectional views showing in an enlarged scale the essential portion of the jet control type carburetor according to a seventh embodiment of the present invention.
Figure 19:
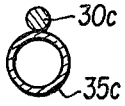

Next, in the carburetor $C_7$ according to a seventh embodiment of the present invention, which belongs to the first example of the first aspect of the present invention, as shown in FIGS. 18 and 19, the differences from the foregoing respective embodiments reside in that a main nozzle 33*c* has its opening 34*c* formed just below a dis-bar (distribution bar) having a circular cross section 30*c* acting as a mixing promoting member and disposed in the smaller venturi 32*c*, whereby the fuel can be sucked and fed out, and in that, at the opposite position to the opening 34*c* of the main nozzle 33*c*, there is opened coaxially with substantially the same diameter a control fluid passage 35*c* having its exit port 39*c* which corresponds to a control fluid nozzle 31*c* and which is opened just below the aforementioned dis-bar 30*c* so as to face the main nozzle 33*c* with a predetermined spacing W.

Moreover, the spacing W between the exit 39*c* of the control fluid passage 35*c* and the opening 34*c* of the main nozzle 33*c* is determined at a preset value. In the carburetor $C_7$ thus constructed according to the seventh embodiment, since the control fluid flows in the form of a jet from the exit port 39*c* of the control fluid passage 35*c* into the separation region which is established behind the dis-bar 30*c*, it receive little influences from the intake air comming from the upstream. As a result, the control fluid can have a remarkably high jet penetration ability so that it can impinge upon the fuel, which is sucked and fed out of the opening 34*c* of the main nozzle 33*c*, without fail thereby to control the fuel flow rate.

Moreover, the opening 34*c* of the main nozzle 33*c* and the exit port 39*c* of the control fluid passage 35*c* can sufficiently control the fuel flow rate, even if the clearance W inbetween has a large value, thereby to attain the effect that the range of the air-fuel ratio can be enlarged in addition to substantially the same operational effects as those of the aforementioned respective embodiments.

Figure 20:
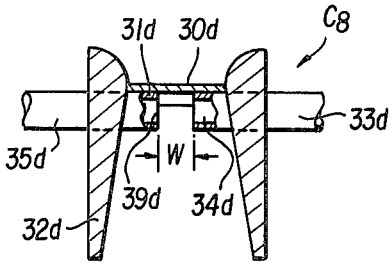
FIGS. 20 and 21 are respectively sectional views showing in an enlarged scale the jet control type carburetor according to an eighth embodiment of the present invention.
Figure 21:
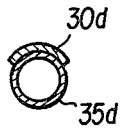

Next, the carburetor $C_8$ according to the eighth embodiment of the present invention, which belongs to the first example of the first aspect according to the present invention, is made different, as shown in FIGS. 20 and 21, from the aforementoned respective embodiments in that a main nozzle 33*d* has its opening 34*d* formed just below a dis-plate (distribution plate) having an arc shaped cross section 30*d*, which is mounted in the smaller venturi 32*d* while having an arcuate cross-section (which is not limitative but has another shape such as a planar or bent cross-section) and which acts as a mixing promoting member, so that the fuel can be sucked and fed out of the opening 34*d* of the main nozzle 33*d*.

The control fluid passage 35*d* has its exit port 39*d* corresponding to a control fluid nozzle 31*d* formed just below the aforementioned dis-plate 30*d* coaxially with substantially the same diameter at the opposite position to the opening 34*d* of the main nozzle 33*d*.

The spacing W between the aforementioned exit port 39*d* and the opening 34*d* is determined at a preset value.

The carburetor $C_8$ thus constructed according to the eighth embodiment can attain substantially the same operational effects as those of the aforementioned respective embodiments.

Figure 22:
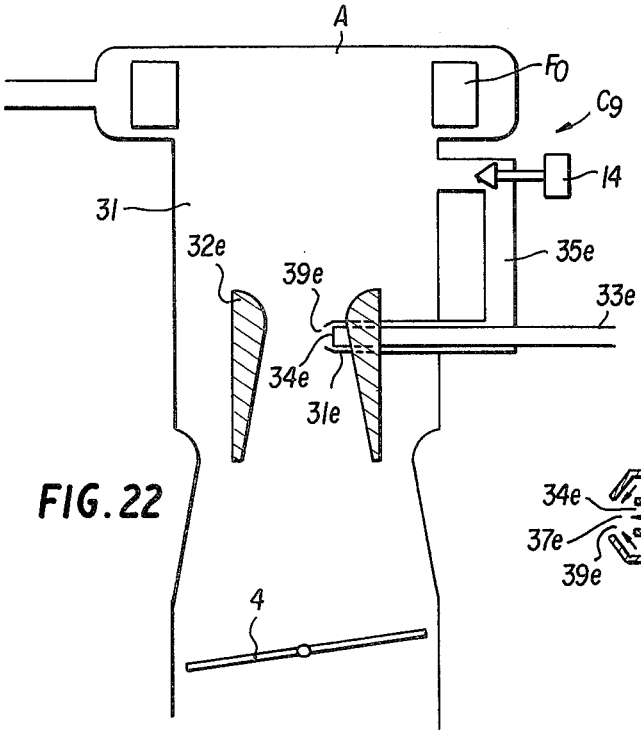
FIGS. 22 and 23 are respectively a longitudinal section and a partially enlarged section showing the jet control type carburetor according to a ninth embodiment of the present invention.
Figure 23:
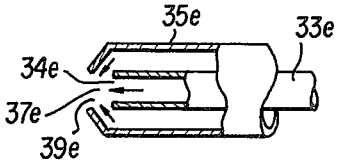

Next, the carburetor $C_9$ according to the ninth embodiment of the present invention which belongs to the first example of the first aspect of the present invention is different, as shown in FIGS. 22 and 23, from the aforementioned respective embodiments in that a main nozzle 33*e* has its opening 34*e* formed in the smaller venturi 32*e* and in that a control fluid passage 35*e* made coaxial and having a larger diameter is mounted on the outer circumference of the main nozzle 33*e* thereby to form a double pipe construction.

Moreover, the control fluid passage 35*e* has its leading end tapered to have an exit port 39*e* corresponding to a control fluid nozzle 31*e*, and the opening 34*e* of the smaller main nozzle 33*e* is fitted therein to provide a communication portion 37*e* between the control fluid and the fuel.

In the carburetor $C_9$ thus constructed according to the ninth embodiment, the fuel to be sucked and fed out into the smaller venturi 32*e* from the opening 34*e* of the main nozzle 33*e* is subjected to the impinging action at the communicationg portion 37*e* by the control fluid which is throttled and injected from the control fluid passage 35*e*. As a result, a kind of flow resistance is imparted to the fuel so that the fuel flow rate is reduced with the resultant practically excellent effect that the fuel flow rate can be controlled more excellently than the aforementioned respective embodiments in addition to substantially the same operational effects as those of the aforementioned respective embodiments.

Incidentally, the carburetor according to the present invention should not be limited to the foregoing embodiments but can be modified in such that the control fluid may be introduced from between the venturi and the throttle valve or from the atmosphere or may be pumped from a pressure reservoir.

Moreover, the actuator may be of any of electromagnetic, hydraulic or pneumatic type and may be exemplified by an ON-OFF valve, a step-motor, a spool valve or a needle valve. The control of the actuator may be accomplished either digitally or analogly. The operating signal of the actuator may include any one or any suitable combination of the signals indicating the engine running conditions in terms of the acceleration, deceleration, idling, warming-up, altitude, load and start. The actuator should not be limited to the oxygen sensor but can be composed of any one or any suitable combination of a temperature sensor, a humidity sensor, a CO sensor, a $CO_2$ sensor, HC sensor, and a $NO_x$ sensor.

Still moreover, the carburetor can be exemplified by a carburetor equipped with a single or multiplex (triple) venturi, a twin carburetor or a variable venturi type carburetor. Thus, the carburetor according to the present invention can attain practically excellent effects that the fuel flow rate can be properly controlled.

Next, in a carburetor $C_{10}$ according to the tenth embodiment of the present invention, which belongs to the second example of the first aspect of the present invention, as shown in FIGS. 30 to 34, the fuel, which is sucked and fed out into an intake pipe 50 through both a main nozzle 52 having its opening facing the inside of the smaller venturi 51 of the double venturi arranged in the intake pipe 50 and a slow port 54 having its opening facing the vicinity of a throttle valve 53 arranged downstream of the smaller venturi 51, is mixed into the intake air flowing through the intake pipe 50 from the air cleaner A thereby to prepare a mixture of a preset air-fuel ratio, which is fed to the combustion chamber 6. The main nozzle 52 has its upstream communicating with the float chamber F through the air bleed 9*a* and the main jet 7 whereas the slow port 54 has its upstream communicating with the float chamber F through the air bleed 9*b* and the slow jet 8.

According to the carburetor $C_{10}$ of the tenth embodiment, it is to be noted that two control fluid nozzles, for blowing the control fluid to the fuel, are provided, i.e., a first control fluid nozzle 55*a* corresponding to an exit side of a first control fluid passage 56 for supplying the control fluid to the main system, and a second control fluid nozzle 55*b* corresponding to an exit side of a second control fluid passage 57 for supplying the control fluid to the slow system. The first control fluid passage 56 has its exit port 56*b* corresponding to the first nozzle 55*a* arranged in the smaller venturi 51 at a position to face the opening of the aforementioned main nozzle 52 so that the control fluid can be sucked and fed out. It is also to be noted that a second control fluid passage 57 has its exit port 58 corresponding to the second nozzle 55*b* arranged downstream of the throttle valve 53 so that the control fluid can be sucked and fed out therethrough. The first and second control fluid passages 56 and 57 have their respective inlet ports 56*a* and 57*a* independently opened downstream of the filter $F_0$ of the air cleaner A.

Moreover, the first and second control fluid passages 56 and 57 are equipped with first and second actuators 14*a* and 14*b* which act as control portion as a throttle means for controlling the air-fuel ratio, respectively. Those actuators 55*b* and 57*b* are electrically connected through the controller 18 to the oxygen sensor 17, which is arranged to face the exhaust pipe 16, thus constituting a closed loop control system. The exhaust pipe 16 has its upstream communicating with the combustion chamber 6 and its downstream connected with the three-way catalyst device 15. Thus, the air-fuel ratio of the carburetor $C_{10}$ of the tenth embodiment can be controlled to the most proper stoichiometric value. Moreover, the first control fluid passage 56 has its exit port 56*b* of substantially the same diameter as that of the opening of the main nozzle 52.

In the carburetor $C_{10}$ thus constructed according to the tenth embodiment, if the oxygen concentration in the exhust gases is found high (the air-fuel ratio of the intake mixture being in lean) by the oxygen sensor 17 arranged to face the exhaust pipe 16, a relating output signal is fed through the controller 18 to the respective first and second actuators 14*a* and 14*b* so that these actuators 18 are rendered conductive to block the supply of the control fluid from the respective exit ports 56*b* and 58 of the first and second control fluid passages 56 and 57.

As a result, the intake air and the fuel accomplish their intrinsic air-fuel ratio controlling operation without being affected by the influence from the control fluid so that the intake air-fuel ratio is shifted from lean to rich sides to promptly restore the stoichiometric value.

In, on the other hand, the oxygen concentration in the exhaust gases is low (the air-fuel ratio of the intake mixture being in rich), a relating output signal is fed through the controller 18 to the first and second actuators 14*a* and 14*b* so that these actuators are rendered inconductive to supply the control fluid from the exit ports 56*b* and 58 of the first and second control fluid passages 56 and 57.

As a result, the air-fuel ratio between the intake air and the fuel is shifted from rich to lean sides to promptly restore the stoichiometric value.

More specifically, the operating conditions of the carburetor $C_{10}$ of the tenth embodiment for the respective running conditions of the engine E will be described in detail in the following.

Figure 31:
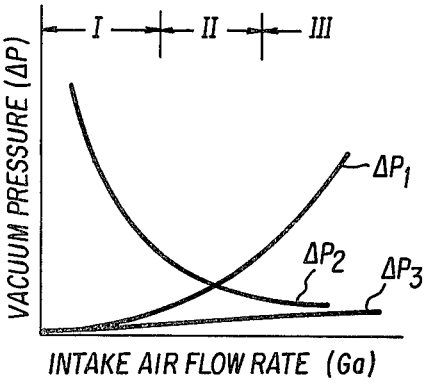
FIG. 31 shows vacuum pressures under respective running speed ranges.

When the throttle valve has a small opening, as the engine E is in its low speed running range, the vacuum pressure $\Delta T$ is in the region indicated at letter I in FIG. 31, which illustrates the respective vacuum pressures $\Delta T1$, $\Delta T2$ and $\Delta T3$ at the venturi 51, in the exit port 58 and in the air cleaner A, so that the vacuum pressure in the intake pipe at slow system is remarkably high.

Figure 32:
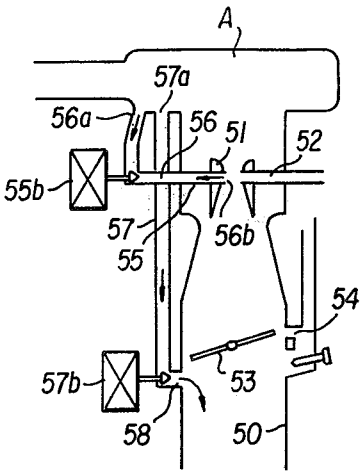

As shown in FIG. 32, as a result, the control flow flows from the air cleaner A to the downstream of the throttle valve 53 only through the second control fluid passage 57 so that the air-fuel ratio at the low running speed range of the engine E can be precisely and easily controlled.

Figure 33:
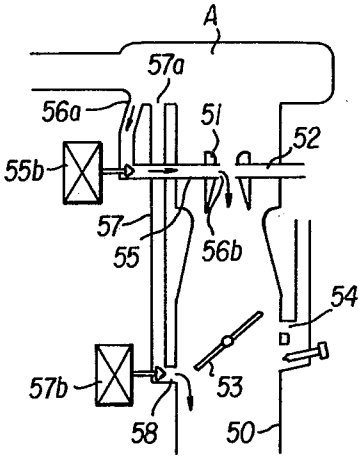

If, on the other hand, the throttle valve 53 is partially throttled, as the engine E is in its medium speed running range, the vacuum pressure is in the range shown at letter II in FIG. 31 so that the exit port 58 and the venturi 51 take substantially the same vacuum pressure. As shown in FIG. 33, therefore, the control fluid flows from the air cleaner A through the first and second control fluid passages 56 and 57 of the first and second air nozzles 55*a* and 55*b* to positions downstream of the venturi 51 and the throttle valve 53, respectively, so that air-fuel ratio at the medium running speed range of the engine E can also be controlled precisely and easily.

Figure 34:
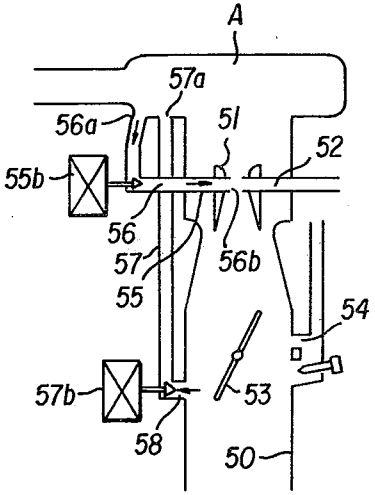
FIGS. 32 to 34 respectively shows schematic views in the respective running speed ranges of FIG. 31.

If, on the other hand, the throttle valve is fully opened, as the engine E is in its high speed running range, the vacuum pressure is in the range shown at letter III in FIG. 31 so that it takes a low value at the exit port 58 but a high value in the venturi 51. As a result, the control fluid flows, as shown in FIG. 34, from the air cleaner A into the venturi 51 only through the first control fluid passage 56 of the first air nozzle 55*a* so that the air-fuel ratio in the high running speed range of the engine E can also be controlled remarkably efficiently.

On the other hand, the fuel discharge during the operation of the aforementioned first actuator 14*a* can be widely changed by changing the spacing W between the exit port 56*b* of the first control fluid passage 56 of the air nozzle 55 and the main nozzle 52.

Thus, there can be attained the practical effect that the fuel discharge can be changed over a wide range of the air-fuel ratio by selecting the aforementioned spacing W at a preset size. In this instance, there could be found little change in the total intake air flow rate between the operations and inoperations of the first and second actuators 14*a* and 14*b*. Thanks to the provisions of the exit ports 56*b* and 58 respectively in the smaller venturi 51 and in the vicinity of the throttle valve 53, there could be found no reduction in the fuel suction and feed ability at the main nozzle 52 and the slow port 54 during the inoperations of the first and second actuators 14*a* and 14*b*.

As a result, the carburetor $C_{10}$ according to the tenth embodiment can enjoy the practical effect that the control of the air-fuel ratio can be performed meanly stably and satisfactorily by determining the spacing W between the exit port 56*b* and the main nozzle 52 and the effective area of the other exit port 58 at preset values and by making the respective actuators 14*a* and 14*b* operative and inoperative.

In the carburetor $C_{10}$ according to the tenth embodiment, moreover, since the output, i.e., the electromotive force of the oxygen sensor 17 for controlling the operations of the respective actuators 14*a* and 14*b* is remarkably varied about the stoichiometric value, the difference of the electromotive force from the instant at the stoichiometric air-fuel ratio is used to vary the operating time periods of the respective actuators 14*a* and 14*b*.

As a result, if the mixture is at a lean side, the difference between the output of the oxygen sensor 17 and the electromotive force at the stoichiometric ratio is negative. Therefore, the time ratio $t_2/t_1$ for rendering the first and second actuators 14*a* and 14*b* inconductive is reduced by the output of the controller 18.

Thus, the time period for which the control fluid is discharged from the respective exit ports 56*b* and 58 is so shortened that the discharge of the fuel is increased to properly change the air-fuel ratio to a rich side.

As a result, in the carburetor $C_{10}$ of the tenth embodiment, since no direct change takes place in the emulsion flow in the main nozzle 52 or in the slow port 54, it is possible to attain the practical effect that the concentration of the mixture can be precisely controlled without inviting any difficulty such as the pulsations or surging in the fuel thereby to enhance the reliability.

Incidentally, the carburetor $C_{10}$ of the tenth embodiment can be exemplified by such a modification that the respective actuators 14*a* and 14*b* as a control portion of the throttle means are made to have needle valves having the effective areas of a throttle portion of the throttle means continuously varied so that the ratio in the flow rate between the intake air and the fuel can be suitably set and controlled by controlling the effective areas of the needle valves.

Although, in the carburetor $C_{10}$ of the tenth embodiment, there are arranged the air bleeds 9*a* and 9*b*, the present invention should not be limited thereto but may be effectively practised by the (not-shown) carburetor equipped with no air bleed.

According to this modification, the discharge pulsations of the fuel due to the existence of the air bleeds can be completely eliminated with the resultant practical effects that the control and operation can be improved and that the construction can be simplified to reduce the production cost.

Figure 37:
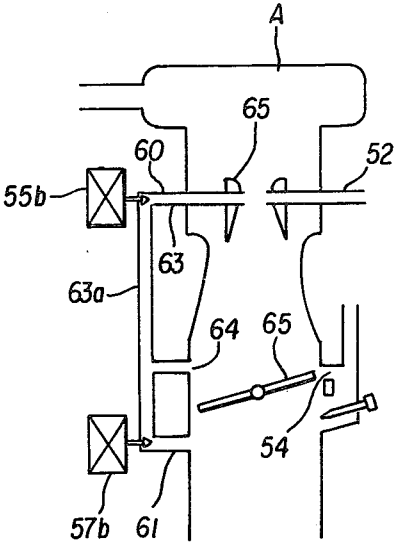
FIGS. 35 to 37 are schematic views showing modifications of the present invention.
Figure 36:
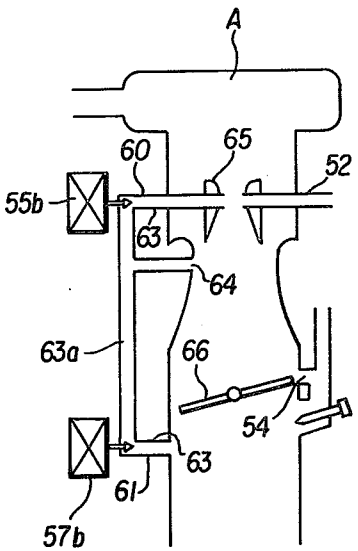
Figure 35:
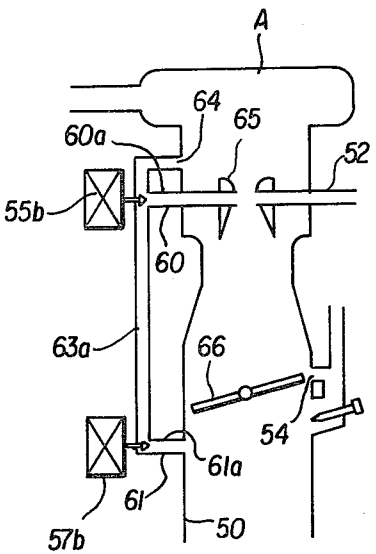

Moreover, the present invention may take such various modifications as are shown in FIGS. 35 to 37.

As shown in FIG. 35, more specifically, a common control fluid passage 63*a* branches off first and second control fluid passages 60 and 61 and their outlet sides opened into the intake pipe to face the fuel correspond to 60*a* and 61*a*, respectively. The control fluid passage 63 may have its inlet port 64 arranged not only in the air cleaner A, as in the foregoing embodiments, but also just upstream of the venturi 65.

As shown in FIGS. 36 and 37, moreover, another modification can be made such that the first and second control fluid passages 60 and 61 may have their inlet port 64 formed between the venturi 65 and the throttle valve 66, i.e., in the vicinity of the venturi 65 or the throttle valve 66.

Figure 42:
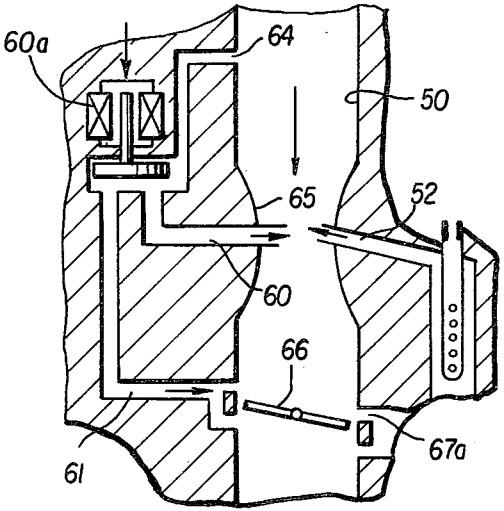
FIGS. 40 to 42 are respectively schematic views showing modifications according to the thirteenth embodiment of the present invention.

According to still another modification, as shown in FIG. 42, the first and second control fluid passages 60 and 61 are equipped with a single electromagnetic valve 60*a* so that the flow rate of the control fluid to the main nozzle and the slow port 67*a* may be controlled together.

Figure 24:
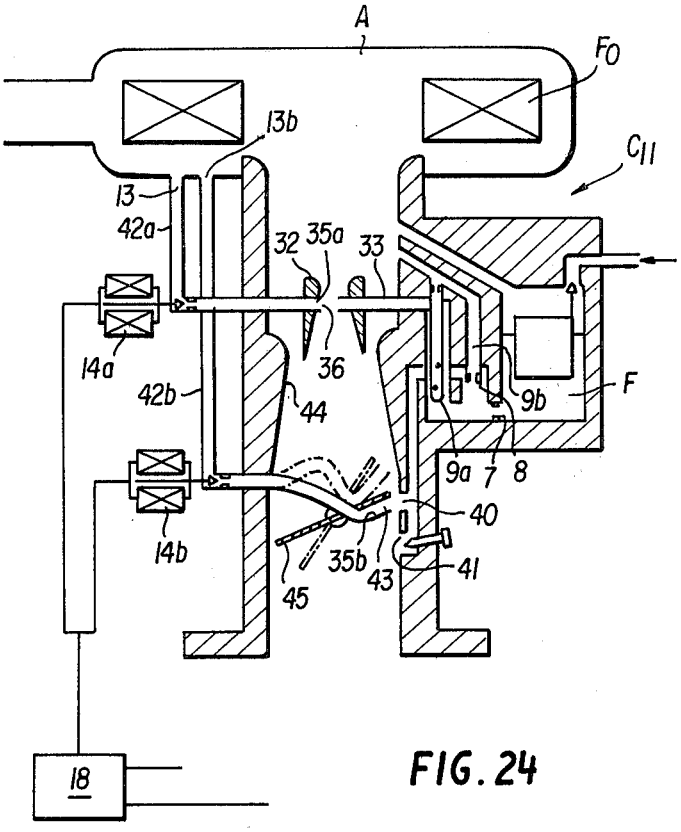
FIG. 24 is a longitudinal section showing the jet control type carburetor according to an eleventh embodiment of the present invention.

Next, the carburetor $C_{11}$ of the eleventh embodiment belonging to the second example of the first aspect in the present invention is an improvement over the aforementioned embodiments, as shown in FIG. 24.

More specifically, in the carburetor $C_{11}$ of the eleventh embodiment, two control fluid nozzles, for blowing the control fluid to the fuel, are provided, i.e., a first control fluid nozzle 35*a* corresponding to an exit side of a first control fluid passage 42*a* for supplying the control fluid to the main system, and a second control fluid nozzle 35*b* corresponding to an exit side of a second control fluid passage 42*b* for supplying the control fluid to the slow system. The second control fluid passage 42*b* has its exit port 43 arranged toward the fuel discharge port of a slow port 40 and/or an idle port 41, i.e., toward the fuel discharge port of the slow port 40 according to the present embodiment. Specifically, the second control fluid passage 42*b* is made of a flexible tube which extend through the wall of an intake pipe 44 until it faces the slow port 40 and which has its end portion mounted from the upper side and along the lower side of a throttle valve 45. The second control fluid passage 42b is made bendable, as shown in broken lines.

In the carburetor $C_{11}$ thus constructed according to the eleventh embodiment, if the second control fluid passage 42b of the second air nozzle 35b is brought into its open condition by the operation of the second actuator 14b, the control fluid directly impinges upon the fuel discharged from the slow port 40 so that the discharge flow rate is reduced by the application of a kind of resistance thereto.

In the carburetor $C_{11}$ of the eleventh embodiment, therefore, the independent discharge fuel flow rates can be obtained in the slow system and in the main system by turning on and off the first and second actuators 14a and 14b. As a result, the carburetor $C_{11}$ of the eleventh embodiment can establish two conditions of different air-fuel ratios by controlling the first and second actuators 14a and 14b. By controlling the ON/OFF time ratio of the first and second actuators 14a and 14b and the effective areas of the passages, moreover, the control of the air-fuel ratio over a wide range can be actually attained. Here, the ratio of the fuel discharge flow rates as a result of the operations of the respective first and second actuators 14a and 14b of the carburetor $C_{11}$ of the eleventh embodiment has such a tendency as is shown in FIG. 25.

Figure 25:
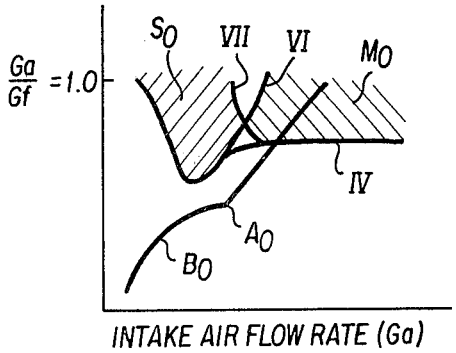
FIGS. 25 and 26 are respectively graphical presentations showing the fuel discharge flow rate of the jet control type carburetor according to the eleventh embodiment of the present invention.
Figure 26:
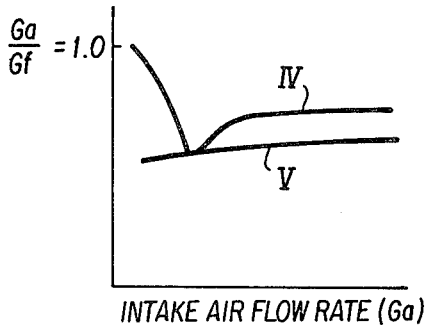

In the eleventh embodiment, moreover, since the exit port 43 of the second control fluid passage 42b is arranged to face the slow port 40 formed in the lower side of the throttle valve 45, the fuel discharge flow rate is controlled in accordance with the tendency shown at letter V in FIG. 26 thereby to increase the effect of the control fluid. As a result, the controlling effect of the slow system has a maximum as shown in FIG. 25. On the other hand, the exit port 43 of the second control fluid passage 42b leaves the more the slow port 40, as the opening of the throttle valve 45 is increased the more, so that the fuel discharge flow rate is controlled in accordance with the tendency shown at a curve IV in FIG. 26 thereby to reduce the effect of the control fluid. As a result, the controlling effect of the slow system has a maximum, as shown by curve VI in FIG. 25.

Since, however, the controlling effect of the main system is started while that of the slow system is still left as shown by a curve VII in FIG. 25, the total controlling capacity of the fuel flow rate by the main and slow systems is at a considerably high level, thus ensuring the practical effect. In FIG. 25, So and Mo respectively show control ranges for a slow system and a main system, and also Ao and Bo respectively show a point at which fuel for a main system is started to spurt and a fuel flow rate in the case where a main system is closed. Other effects obtainable by the eleventh embodiment are similar to those of the aforementioned embodiments.

According to the second example of the first aspect of the present invention a carburetor of the type has been described in which both the aforementioned main and slow systems are enabled to control the air-fuel ratio. In this system carburetor, the control fluid communication passages for the main and slow systems may be independently provided, or may be made to branch from a common communication passage.

In the former type carburetor, the control fluid communication passages for the main and slow systems are independently opened to have communication either with the upstream of the opening of the main nozzle or with the upstream up to the throttle valve.

In the carburetor thus constructed, since the control fluid passages for the main and slow systems are arranged independently of each other, the control air flows for the main and slow system can be retained without influencing each other, and the respective fuel discharges from the main nozzle and the slow port are controlled as shown in FIG. 25 so that the control range of the air-fuel ratio of the mixture can be set at an easily controllable value thereby to facilitate the precise control of the air-fuel ratio of the mixture.

On the other hand, in the latter type carburetor according to the second example of the first aspect of the present invention, the control fluid communication passage for the main system and the control fluid communication passage for the slow system are made to branch upstream of the control valve as a throttle means into a common communication passage, which is opened to have communication either with the upstream of the opening of the main nozzle or with the downstream up to the throttle valve, and the downstream portions of the control valve as a throttle means may be still left as the respective control air communication passages for the main and slow systems.

In the carburetor thus constructed, since the control air communication passages for the main and slow systems have their portions upstream of the control valve as a throttle means formed into the common communication passage, the construction can be simplified, while retaining the control air flows for the main and slow systems, and the respective fuel flow rates from the main nozzle and the slow part are controlled so that the air-fuel ratio of the mixture can be precisely controlled with ease.

Furthermore, in the latter type carburetor according to the second example of the first aspect of the present invention, the control air communication passages for the main and slow systems may be made to branch downstream of the control valve as a throttle means to communicate the air bleeds of the main and sow system fuel passages, respectively.

In the carburetor thus constructed, jets are blown respectively into the flows of the fuel, which are sucked and fed out of the main and slow systems into the intake pipe so that the fuel flow rate can be controlled through the application of the kinetic energy. By blowing the control air into the fuel of the main and slow systems under an emulsion condition in the air bleeds before it is sucked and fed out into the intake pipe, moreover, the fuel flow rate can be controlled thereby to control the air-fuel ratio of the mixture to the most proper value.

Figure 27:
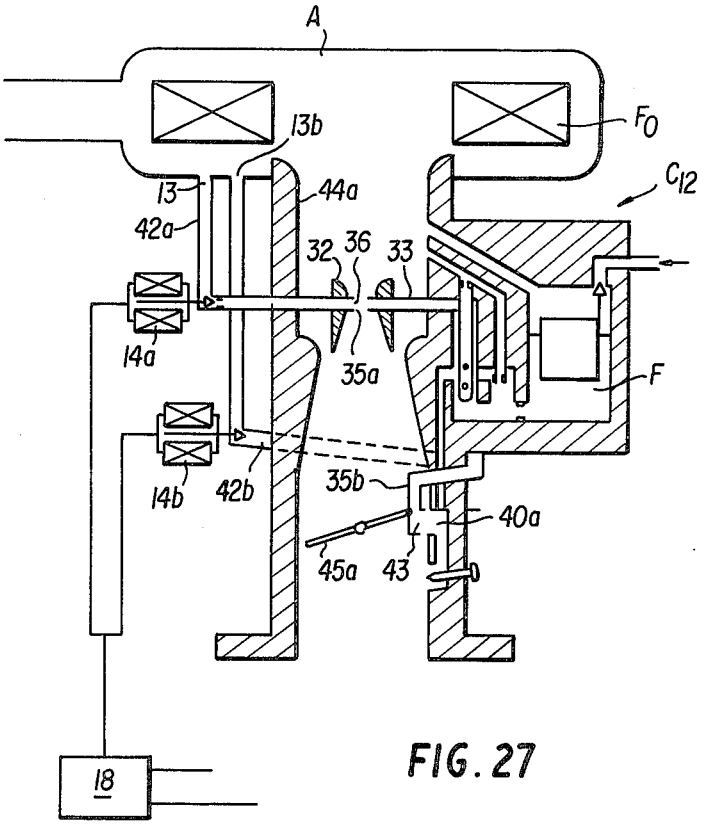
FIGS. 27 and 28 are respectively a longitudinal section and a partial transverse section showing the jet control type carburetor according to a twelfth embodiment of the present invention.
Figure 28:
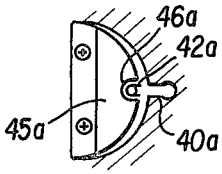

Next, in the carburetor $C_{12}$ of the twelfth embodiment belonging to the second example of the first aspect of the present invention, as shown in FIGS. 27 and 28, the difference from the aforementioned tenth embodiment resides in that the second control fluid passage 42b is mounted on the outer circumference of an intake pipe 44a and then is made to extend through the wall at the side of the slow port 40a until its end portion is fitted in the slit 46a of a throttle valve 45a while being directed toward the fuel discharge port of the slow port 40a.

According to the carburetor $C_{12}$ of the twelfth embodiment, since the second control fluid passage 42b of the slow system is used to discharge the control fluid into the slow port 40a always from a preset position irrespective of the opening and closing operations of the throttle valve 45a for the subsequent impinging purposes, the fuel discharge flow rate from the slow port 40*a* can be uniformly controlled, as a result, the ratio of the fuel discharge flow ratio is almost constant to the air flow rate (Ga) as shown at curve V in FIG. 26. Other but substantially similar operational effects to those of the aforementioned respective embodiments can be attained.

Figure 29:
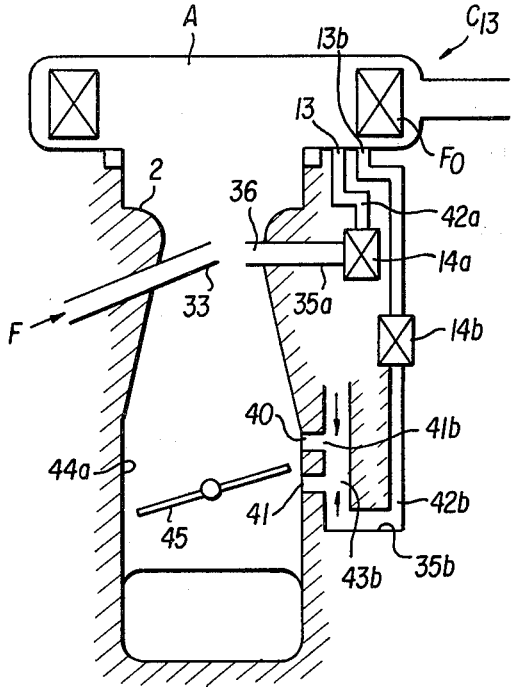
FIG. 29 is a longitudinal section showing the jet control type carburetor according to a thirteenth embodiment of the present invention.
Figure 30:
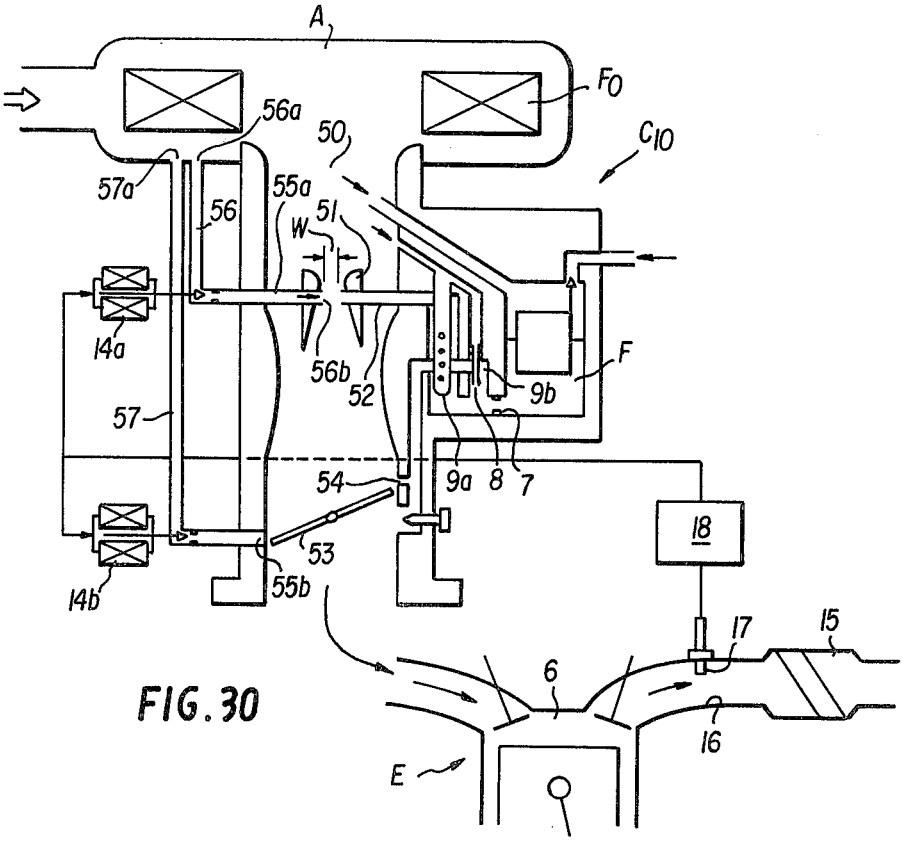
FIG. 30 is a longitudinal section showing the jet control type carburetor according to the tenth embodiment of the present invention.

Next, a carburetor $C_{13}$ of the thirteenth embodiment according to the present invention, which belongs to the second example of the first aspect of the present invention, is made, as shown in FIG. 29, to have substantially the same construction as those of the aforementioned respective embodiments excepting that a second control fluid passage 42*b* has its exit port 43*b* opened upstream of the fuel discharge port of the slow port 40 and in the wall of the intake pipe 44*a*.

In the carburetor $C_{13}$ thus constructed according to the thirteenth embodiment, a kind of resistance can be applied by bringing the control fluid into direct impingement upon the fuel flow discharged from the slow system before it is discharged into the intake pipe 44*a* with the resultant practical effect that the fuel discharge flow rate of the slow system can be more precisely controlled than the aforementioned respective embodiments in addition to substantially the same operational effects as those of the aforementioned respective embodiments.

The present invention may be modified, as shown in FIGS. 38 and 39, such that the fuel discharge flow rate of the slow system can also be properly controlled by discharging the control fluid at a right angle with respect to the axis of the idle port 67.

Figure 41:
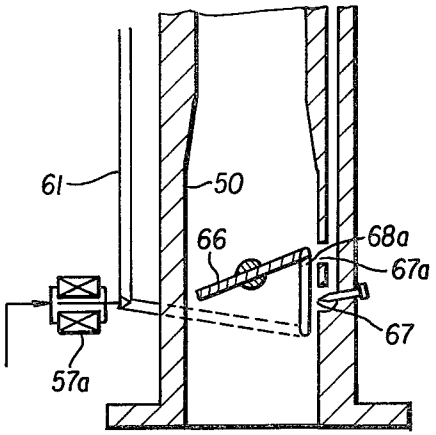
Figure 40:
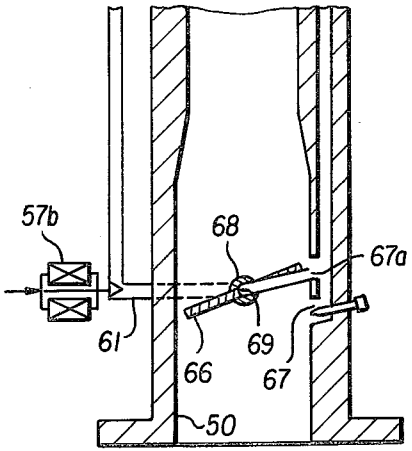

In another modification, as shown in FIGS. 40 and 41, the second control fluid passage 61 for supplying the control fluid to the slow system is so modified that the throttle shaft 68 of a throttle valve 66 is formed with an inner hole 69, of which exit port 68*a* faces a slow port 67*a*.

In a further modification as shown in FIG. 41, the second control fluid passage 61 is bent to have its exit port 68*a* facing the slow port 67*a* outside the rotating range of the throttle valve 66.

Figure 43:
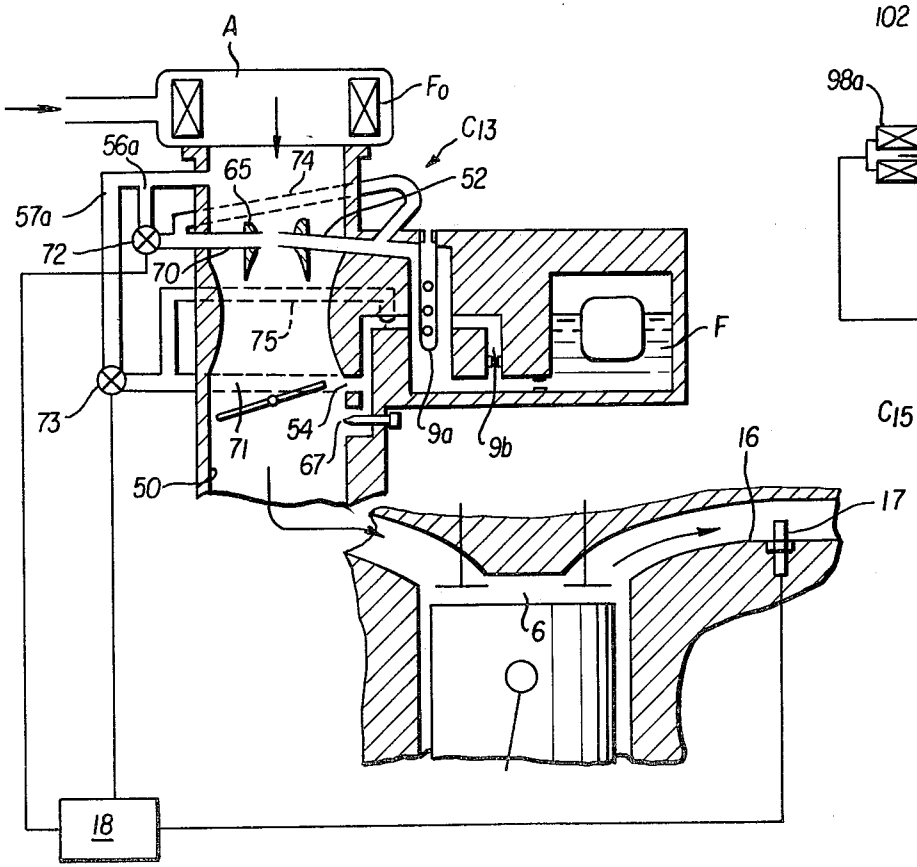
FIG. 43 is a schematic view showing further modification according to the thirteenth embodiment of the present invention.

As shown in FIG. 43, the carburetor of the present invention can be further modified such that the first and second control fluid passages 70 and 71 are made to have communications downstream of first and second actuators 72 and 73 with the air bleeds 9*a* and/or 9*b* for the main and slow systems, i.e., with the both bleeds according to the embodiment under discussion. Thus, the fuel discharge flow rate of the main or slow system can be more precisely controlled than the aforementioned respective embodiments so that the air-fuel ratio can be controlled over a wide range properly for the various running conditions of the engine in addition to substantially the same operational effects as those of the aforementioned respective embodiments.

Figure 44:
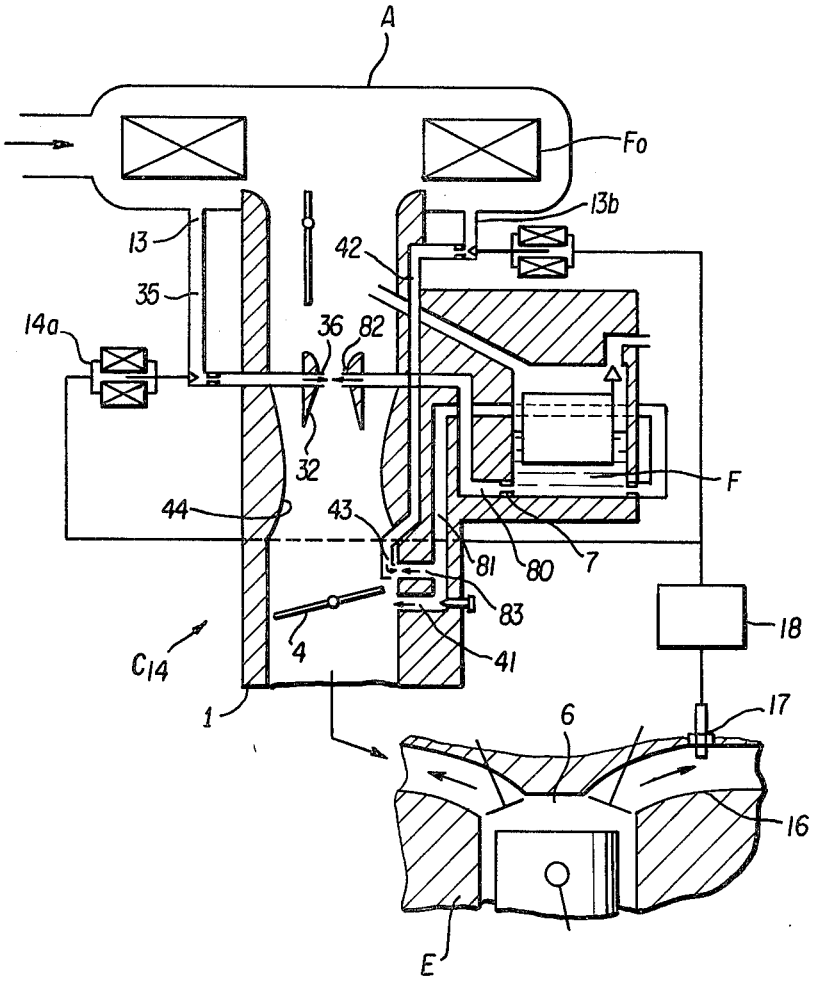
FIG. 44 is a schematic view showing the carburetor according to a fourteenth embodiment of the present invention.

A carburetor $C_{14}$ of the fourteenth embodiment according to the present invention is of the type, in which the flow rates of the respective fuel passages 80 and 81 for the main and slow systems are controlled in accordance with the running conditions of the engine, as shown in FIG. 44. The fourteenth embodiment belongs to the second mode of the second example in the present invention. In this type carburetor, the air bleed mechanism is eliminated, and the respective fuel passages 80 and 81 for the main and slow systems are connected to the float chamber F without passing the jets of the other fuel passages.

Since the carburetor $C_{14}$ of this fourteenth embodiment is equipped with no air bleed mechanism, there arises no pulsation in the fuel flow due to the existence of the air bleeds, accordingly, no pulsation in the air-fuel ratio of the mixture.

Since, on the other hand, the main fuel passage 80 and the slow fuel passage 81 are connected to the float chamber F without bypassing the jet of the other fuel passage, it is sufficient, when the jets of the respective fuel passages are to be selected, to take only the flow rate of that fuel passage into consideration, but it is not necessary to take the flow rate of the other fuel passage into consideration, as is different from the carburetor, in which one of the fuel passage is connected to the float chamber through the jet of the other fuel passage.

Thus, it is possible to freely select each jet by taking only the flow rate of its fuel passage into consideration. As a result, by properly selecting each jet, the quantity of the respective fuel flows from the main nozzle 82 and the slow port 83, which is to be controlled, can be so reduced that the control range of the air-fuel ratio of the mixture can be set at an easily controllable proper value. Thus, it is easy to precisely control the air-fuel ratio of the mixture.

Figure 45:
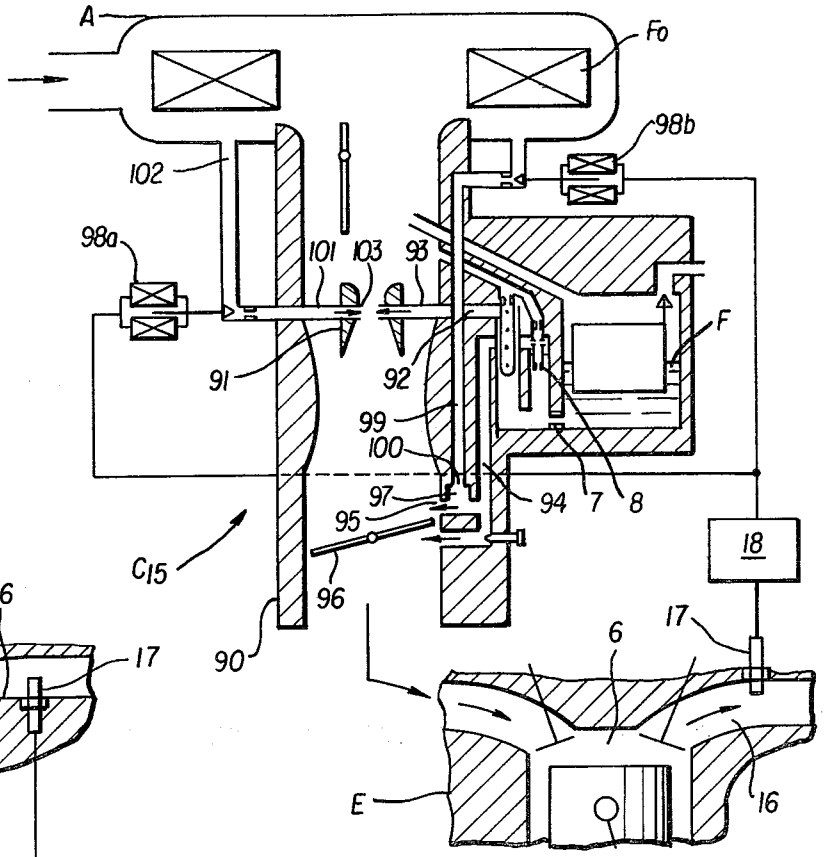
FIG. 45 is a schematic view showing the carburetor according to a fifteenth embodiment of the present invention.

The carburetor $C_{15}$ of the fifteenth embodiment according to the fourth mode of the present invention is constructed, as shown in FIG. 45, such that the main nozzle 93 of a main system fuel passage 92 opened into the venturi 91 of an intake pipe 90, that the slow port 95 of a slow system fuel passage 94 is opened into the inner circumference of the intake pipe 90 and in the vicinity of a throttle valve 96, that an air chamber 97 is formed just upstream of the slow port 95 of the slow fuel passage 94, that there is connected to this air chamber 97 an exit port 100 of a control air communication passage 99 which is equipped with such an actuator 98 as is operative in accordance with the running conditions of the engine E, that an air nozzle 101 for injecting the air, which is made to impinge upon the fuel sucked from the main nozzle 93 by the vacuum pressure in the intake air flowing in the intake pipe 90, is arranged to face the opening of the main nozzle 93, and that there is connected to the air nozzle 101 the exit port 103 of the control air communication passage 102 which is equipped with the actuator 98 made operable in accordance with the running conditions of the engine E, whereby the flow rates of both the fuel sucked from the aforementioned main nozzle 93 and the fuel sucked from the slow port 95 are controlled by the impinging force of the air injected from the air nozzle 101 and the air pressure in the air chamber 97, respectively.

In the carburetor $C_{15}$ of the fifteenth embodiment, in the main nozzle 93, the air injected from the air nozzle 101 is made to impinge upon the fuel sucked from the main nozzle 93 by the vacuum pressure in the intake pipe 90 so that the fuel is sucked by the pressure of the summation of the vacuum pressure in the intake pipe and the impinging force of the air. Thus, the quantity of the fuel to be sucked is controlled by the impinging force of the air spurting from the air nozzle 101.

In the slow port 95 equipped with the air chamber 97, on the other hand, the quantity of the fuel to be sucked is controlled by the air pressure in the air chamber 97 so that the air-fuel ratio of the intake mixture is controlled by the air pressure in the air chamber 97, which is varied in accordance with the running conditions of the engine. As a result, as is different from the prior art caburetor in which air is additionally mixed into the fuel under the emulsion condition, there arises no pulsation in the fuel to be sucked from the main nozzle or from the slow port 95 so that the air-fuel ratio of the intake mixture can be precisely controlled.

Figure 46:
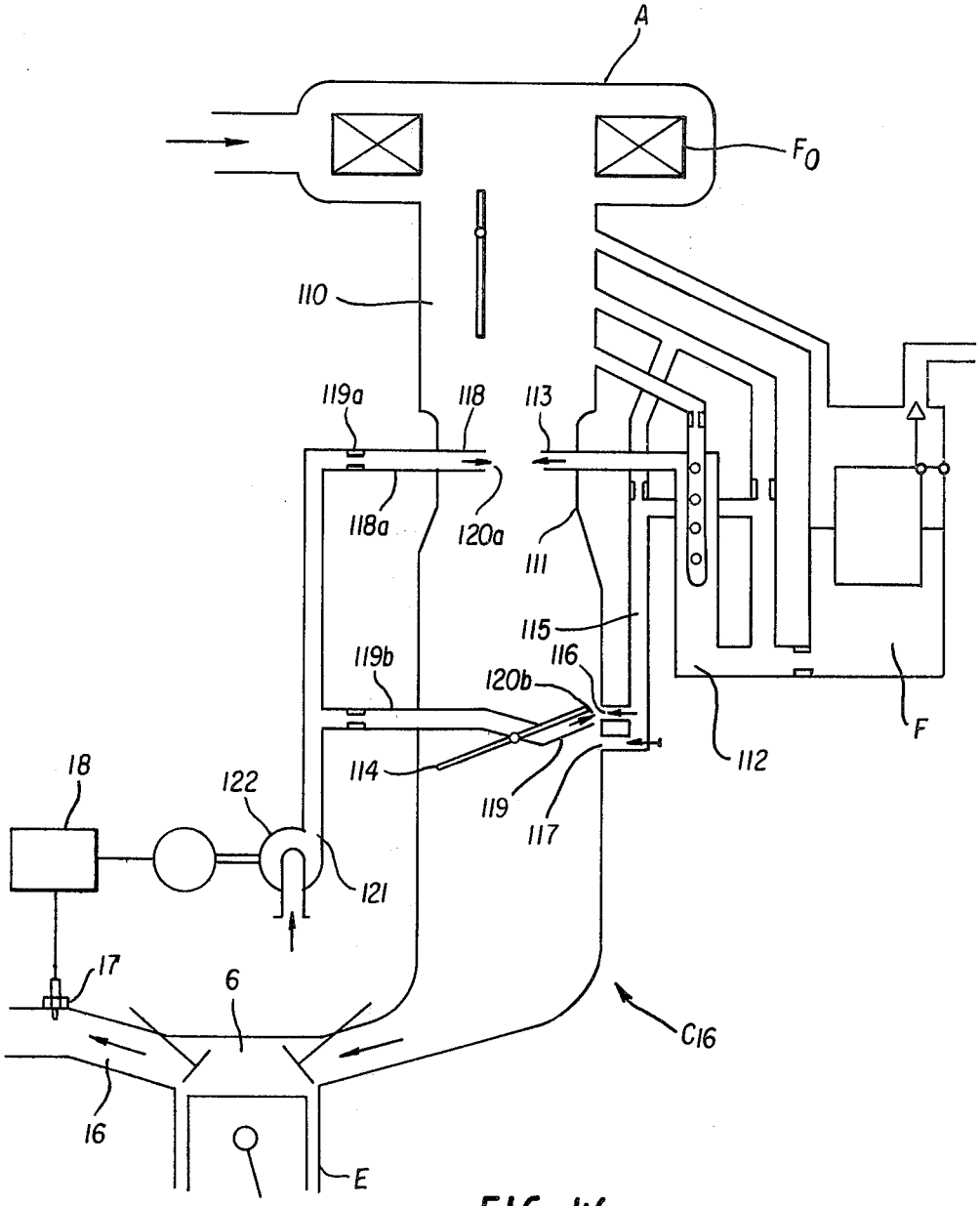
FIG. 46 is a schematic view showing the carburetor according to a sixteenth embodiment of the present invention.

Next, the carburetor $C_{16}$ of the sixteenth embodiment according to the fifth mode of the present invention is constructed, as shown in FIG. 46, such that a main nozzle 113 connected to the main system fuel passage 112 is opened into the venturi 111 of an intake pipe 110, that the slow port 116 and idle port 117 of a slow system fuel passage 115 are opened into the intake pipe 110 in the vicinity of the throttle valve 114, that an air nozzle 118 for injecting air to impinge upon the fuel, which is sucked from the main nozzle 113 or the slow or idle port 116 or 117 by the vacuum pressure in the intake pipe 110, corresponds to an exit side of a control air passage 118*a* to face the main nozzle 113, and that an air pump 112 for controlling the discharge pressure or flow rate in accordance with the running conditions of the engine E is connected with an inlet port 121 of the control air passage 118*a*.

In the carburetor $C_{16}$ thus constructed according to the sixteenth embodiment, the air injected from the air nozzle 118 is made to impinge upon the fuel sucked from the main nozzle 113 or the slow or idle port 116 or 117, and either the discharge pressure or flow rate of the air pump 122 for supplying the air nozzle with air is increased or decreased in accordance with the running conditions of the engine E. Moreover, the flow rate of the fuel from the main nozzle 113 or the slow or idle port 116 or 117 is controlled by the variation in the impinging force of the air injected from the air nozzle 118 for main system or air nozzle 119 for slow system.

As is different from the conventional carburetor in which air is additionally mixed into the fuel flowing under the emulsion condition through the fuel passage, there arises no pulsation in the fuel emanating from the main nozzle 113 or the slow or idle port 116 or 117 so that the quantity of the fuel can be precisely controlled to precisely control the air-fuel ratio of the mixture.

As a result, there arises no fluctuation in the engine output nor emission of the noxious contents in the exhaust gases, which might otherwise be cased by the fluctuations in the air-fuel ratio of the mixture.

Figure 47:
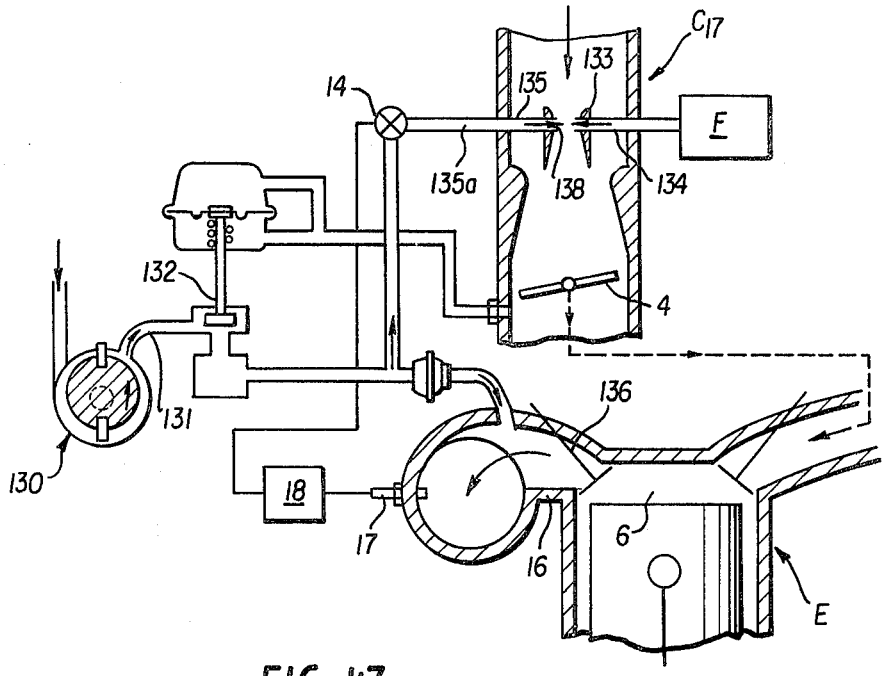
FIG. 47 is a schematic view showing the carburetor according to a seventeenth embodiment of the present invention.

Next, a carburetor $C_{17}$ of the seventeenth embodiment according to the first mode of the second example of the second aspect in the present invention is directed, as shown in FIG. 47, to the case in which the carburetor $C_{17}$ is equipped with a secondary air supply system for improving the combustion phenomena and the clearing efficiency of the catalyst and in which the pressurized secondary air is used as a control fluid. More specifically, a discharge port 131 of an air pump 130 which is rotationally driven by the engine E is made to have communication with the inside of a venturi 133 of the carburetor $C_{17}$ through a control valve 132, which is opened and closed by the atmospheric pressure and by the intake pressure by way of the branches of a control fluid passage 135*a* of which exit side corresponds to a fluid nozzle 135 arranged to face the main nozzle 134, an exhaust pipe 16 downstream of the exhaust valve 136, and a backflow check device 137 downstream of the oxygen sensor 17 and upstream of the three-way, oxidizing or reducing catalyst device (although not shown). There is mounted in the aforementioned control fluid passage 135 the actuator 14 which is connected with the aforementioned oxygen sensor 17 through the controller 18, so that the effective area of the control fluid passage 135 is made variable.

In the device thus constructed according to the seventeenth embodiment, as is different from the aforementioned respective embodiments, since the pressurized secondary air is used as the control fluid, if the oxygen concentration in the exhaust gases is low (i.e. the air-fuel ratio of the intake mixture being in rich), the oxygen sensor 17 feed a preset output signal to the controller 18 to operate and turn on the actuator 14 so that the pressurized secondary air is injected from an exit port 138 of the control fluid nozzle 135 toward the main nozzle 134 because the control valve 132 is opened. As a result, the fuel sucked and fed out of the main nozzle 134 is subjected to the flow resistance due to the impingement of the secondary air so that its flow rate can be controlled more precisely and excellently responsively.

As a result, the carburetor $C_{17}$ of the seventeenth embodiment can enjoy the operational effects that the air and fuel can be controlled to the most proper air-fuel ratio and that the combustion can be so improved as to remarkably improve the exhaust purifying efficiency, as compared with the prior art, in addition to substantially the same operational effects as those of the aforementioned respective embodiments.

Figure 48:
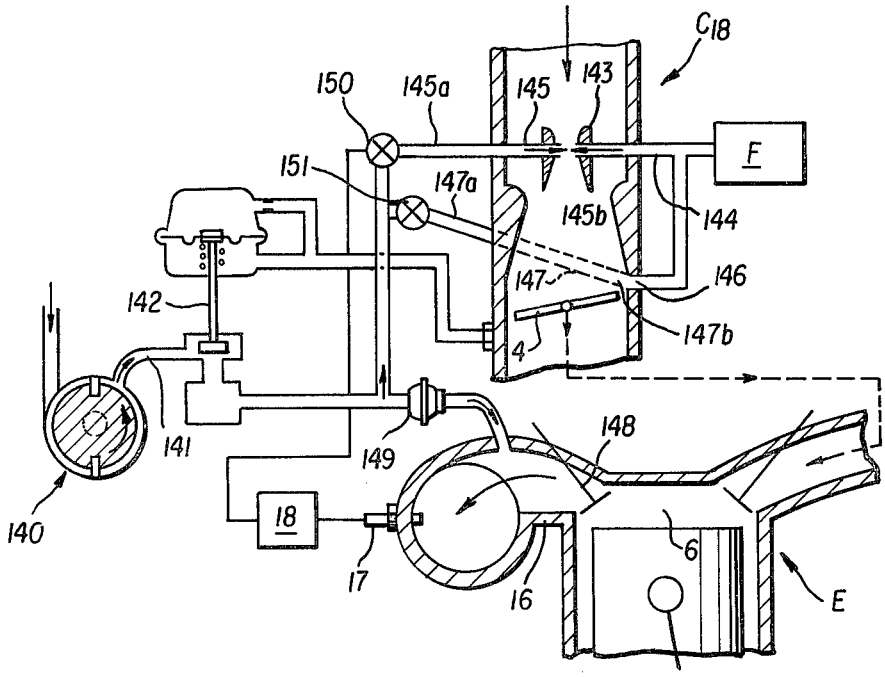
FIG. 48 is a schematic view showing the carburetor according to an eighteenth embodiment of the present invention.

The present invention should not be limited to the aforementioned embodiments but can be modified into the eighteenth embodiment, as shown in FIG. 48, which belongs to the second mode of the second example of the second aspect in the present invention.

A carburetor $C_{18}$ according to the eighteenth embodiment is for the engine E equipped with a secondary air supply system for improving the combustion phenomena or the purifying efficiency of the exhaust gases due to the catalyst itself and in which the pressurized secondary air is used as the control fluid.

More specifically, a discharge port 141 of an air pump 140 rotationally driven by the engine E is made to have communication with the inside of a venturi 143 of the carburetor $C_{18}$ through a control valve 142, which is opened and closed by the atmospheric pressure and the intake pressure, by way of the branches of a first control fluid passage 145*a* of which exit port 45*b* corresponds to first control fluid nozzle 145 opened to face the main nozzle 144, a second control fluid passage 147*a* of which exit port 147*b* corresponds to a second fluid nozzle 147 opened to face the slow port 146, an exhaust pipe 16 downstream of the exhaust valve 148 and backflow check device 149 downstream of the oxygen sensor 17 and upstream of the three-way, oxidizing or reducing catalyst device (although not shown). There is mounted in the first and second control fluid passages 145*a* and 147*a* first and second actuators 150 and 151 as a control portion of a throttle means, which are electrically connected with the aforementioned oxygen sensor 17 through the controller 18 so that the effective areas of the first and second control fluid passages 145*a* and 147*a* are made variable.

In the carburetor $C_{18}$ thus constructed according to the eighteenth embodiment, as is different from the aforementioned respective embodiments, since the pressurized secondary air is used as the control fluid, if the oxygen concentration of the exhaust gases is low (i.e. the air-fuel ratio of the intake mixture being in rich), the oxygen sensor 17 feeds a preset output signal to the controller 18 to operate and turn on the first and second actuators 150 and 151 so that the pressurized secondary air is injected from the exit ports 145*b* and 147*b* toward the main nozzle 144 and the slow port 146 because the control valve 142 is opened. As a result, the fuel to be sucked and fed out of the main nozzle 144 and the slow port 146 is subjected to the flow resistance coming from the impingement with the secondary air so that its flow rate can be controlled more accurately and excellently responsively.

As a result, the carburetor $C_{18}$ of the eighteenth embodiment can enjoy the operational effects that the air and fuel can be controlled to the most proper air-fuel ratio and that the combustion can be so improved as to remarkably improve the exhaust purifying efficiency, as compared with the prior art, in addition to substantially the same operational effects as those of the aforementioned respective embodiments. As compared with the foregoing description, moreover, the fuel flow rate for the slow system can be finely controlled.

Figure 49:
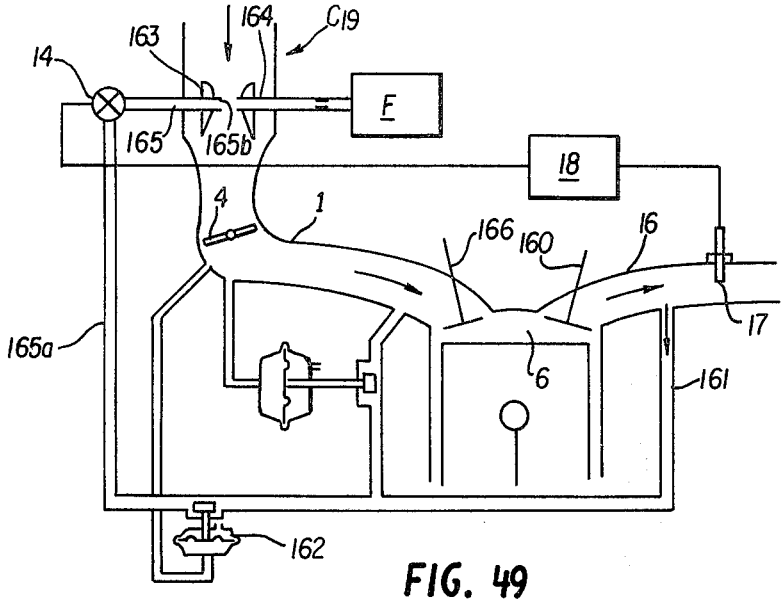
FIG. 49 is a schematic view showing the carburetor according to a nineteenth embodiment of the present invention.

A carburetor $C_{19}$ of the nineteenth embodiment according to the present invention, as shown in FIG. 49, is directed to a carburetor for an engine E equipped with an EGR system for removing the noxious contents in the exhaust gases and in which the exhaust gases under a preset pressure are used as a control fluid. More specifically, an exhaust gas recirculation passage 161 communicating with the exhaust pipe 16 downstream of the exhaust valve 160 of the combustion chamber 6 branches off so as to communicate with both of a control fluid passage 165*a* of which an exit side corresponds to a control fluid nozzle 165, which is opened to face the main nozzle 164 in the venturi 163 of the carburetor $C_{19}$ through such a control valve 162 as is opened and closed by the atmospheric pressure and the intake pressure, and of the intake pipe 1 upstream of the intake valve 166. There is mounted in the aforementioned control fluid passage 165*a* an actuator 14 as a control portion of a throttle means which is electrically connected with the oxygen sensor 17 through the controller 18 so that the effective area of the control fluid passage 165 is made variable.

In the carburetor $C_{19}$ thus constructed according to the nineteenth embodiment, if the oxygen concentration in the exhaust gases is low (i.e. the air-fuel ratio of the intake mixture being in rich, the oxygen sensor 17 feed a preset output signal to the controller 18 to operate and turn on the actuator 14 so that a portion of the exhaust gases are injected from the exit port 165*b* of the control fluid passage 165*a* toward the main nozzle 164 because the control valve 162 is opened. As a result, the fuel to be sucked and fed out of the main nozzle 164 is subjected to the flow resistance coming from the impingement with the exhaust gases so that its flow rate can be controlled more accurately and excellently responsively.

As a result, the carburetor $C_{19}$ of the nineteenth embodiment can enjoy the operational effects that the air and fuel can be controlled to the most proper air-fuel ratio and that the combustion can be so improved as to remarkably improve the exhaust purifying efficiency, as compared with the prior art, in addition to substantially the same operational effects as those of the aforementioned respective embodiments.

Figure 50:
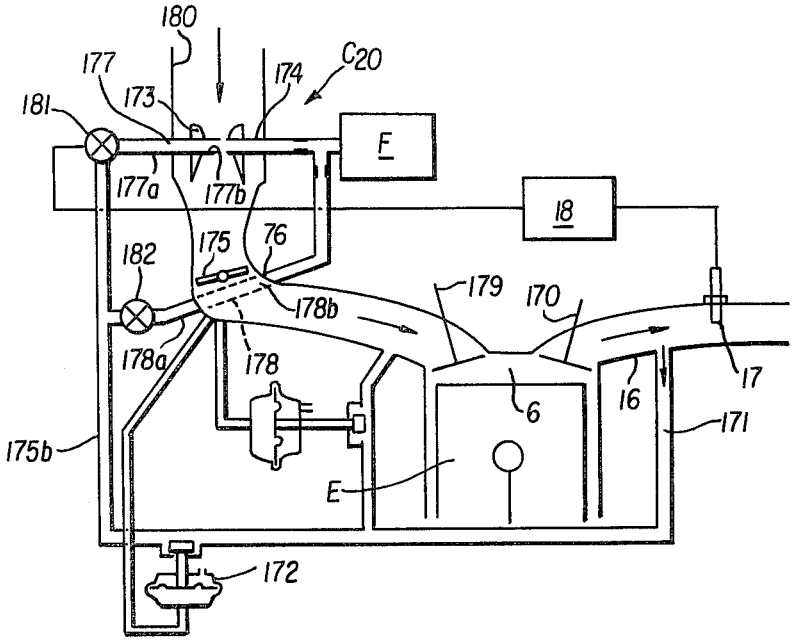
FIG. 50 is a schematic view showing the carburetor according to a twentieth embodiment of the present invention.

A carburetor $C_{20}$ of the twentieth embodiment according to the present invention, as shown in FIG. 50, is directed to a carburetor for an engine E equipped with an EGR system for removing the noxious contents in the exhaust gases and in which the exhaust gases under a preset pressure are used as a control fluid.

More specifically, an exhaust gas recirculation passage 171 communicating with the inside of the exhaust pipe 16 downstream of the exhaust valve 170 of the combustion chamber 6 branches off so as to communicate with first and second control fluid passages 177*a* and 178*a* of which exit ports 177*b* and 178*b* respectively corresponds to first and second control fluid nozzles 177 and 178. The exit ports 177*b* and 178*b* of the first and second control fluid passages 177*a* and 178*a* are respectively opened to face both of the main nozzle 174 in the venturi 173 of the carburetor $C_{20}$ through such a control valve 172 as is opened and closed by the atmospheric pressure and the intake pressure and of the slow port 176 in the vicinity of the throttle valve 175, and with the intake pipe upstream of the intake valve 179. The first and second control fluid passages 177*a* and 178*a* are respectively equipped with first and second actuators 181 and 182 as a control portion of a throttle means, which are electrically connected with the oxygen sensor 17 through the controller 18. Thus, the effective areas of the respective control fluid passages are made variable.

In the carburetor $C_{20}$ thus constructed according to the twentieth embodiment, if the oxygen concentration in the exhaust gases is low (i.e. the air-fuel ratio of the intake mixture being in rich), the oxygen sensor 17 feeds a preset output signal to the controller 18 to operate and turn on the actuators 181 and 182 so that a portion of the exhaust gases are injected from the exit ports 177*a* and 178*a* toward the main nozzle 174 and the slow port 175 because the actuator 80 is turned on whereas the control valve 172 is opened. As a result, the fuel to be sucked and fed out of the main nozzle 174 and the slow port 175 is subjected to the flow resistance coming from the impingement with the exhaust gases so that its flow rate can be controlled more accurately and excellently responsively. Since the slow system is also controlled in the above carburetor $C_{20}$, the air-fuel ratio can be accomplished more finely. As a result, the carburetor $C_{20}$ of the twentieth embodiments can enjoy the operational effects that the air and fuel can be controlled to the most proper air-fuel ratio and that the combustion can be so improved as to remarkably improve the exhaust purifying efficiency, as compared with the prior art, in addition to substantially the same operational effects as those of the aforementioned respective embodiments.

Figure 51:
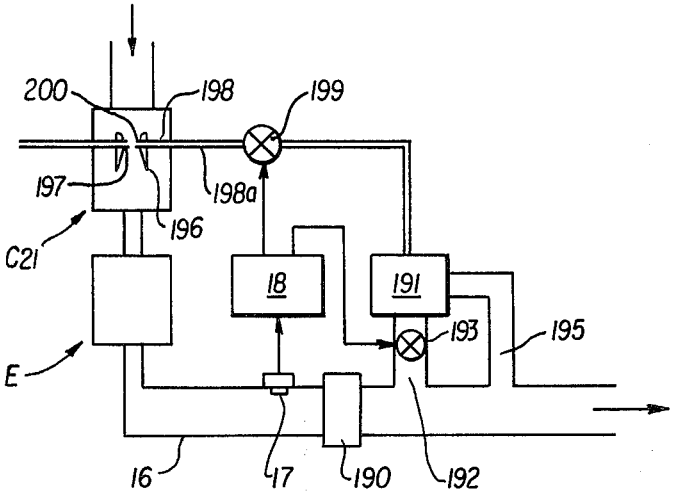
FIG. 51 is a schematic view showing the carburetor according to a twenty first embodiment of the present invention.

Next, a carburetor $C_{21}$ of the twenty first embodiment according to the present invention is directed, as shown in FIG. 51, to a carburetor of hydrogen addition type and in which hydrogen gases are used as a control fluid.

More specifically, the exhaust pipe 16 downstream of the exhaust valve of the combustion chamber (although both not shown) of the engine E is equipped with the oxygen sensor 17 and with an oxidizing catalyst device 190 which is disposed downstream of the former. Downstream of the oxidizing catalyst device 190, there is disposed through a first actuator 193 an exhaust supply passage 192 which is made to have communication with a reservoir 191 for reserving metal hydrides or the like, and there is also disposed an exhaust discharge passage 195 for returning the exhaust gases again to the exhaust pipe 16 after having passed through the reservoir 191. In order to supply the hydrogen gases, which are generated as a result of the chemical reactions of the metal hydrides or the like due to the waste heat of the exhaust gases, that reservoir 191 is made to have communication through a second actuator 199 with the control fluid passage 198*a* of which an exit port 200 corresponds to a control fluid nozzle 198 which is opened to face the main nozzle 197. The aforementioned first and second actuators 193 and 199 are electrically connected through the controller 18 with the oxygen sensor 17.

In the carburetor $C_{21}$ thus constructed according to the twenty first embodiment, if the oxygen concentration in the exhaust gases is low (i.e., the air-fuel ratio of the intake mixture being in rich), the oxygen sensor 17 feed a preset output signal to the controller 18 to operate and turn on the first and second actuators 193 and 199 so that hydrogen gases are generated and injected from the exit port 200 of the control fluid passage 198*a* toward the main nozzle 197. As a result, the fuel to be sucked and fed out of the main nozzle 197 is subjected to the flow resistance coming from the impingement with the hydrogen gases so that its flow rate is controlled precisely and efficiently.

As a result, the carburetor $C_{21}$ of the twenty first embodiment can enjoy the operational effects that the air and fuel can be controlled to the most proper air-fuel ratio, that the lean combustion can be realized by the addition of the hydrogen gases, while inviting the practically significant effect of reduction in the cost for the fuel, and that the combustion can be so improved as to remarkably improve the exhaust cleaning efficiency, in addition to substantially the same operational effects as those of the aforementioned respective embodiments.

Figure 52:
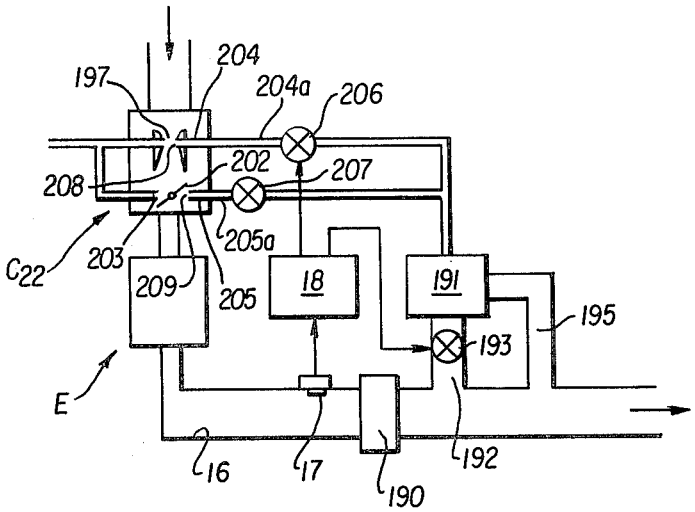
FIG. 52 is a schematic view showing the carburetor according to a twenty second embodiment of the present invention.

Next, a carburetor $C_{22}$ of a twenty second embodiment according to the present invention is directed, as shown in FIG. 52, to a carburetor of hydrogen gas addition type and in which hydrogen gases are used as a control fluid.

More specifically, the exhaust pipe 16 downstream of the exhaust valve of the combustion chamber (although both not shown) of the engine E is equipped with the oxygen sensor 17 and with an oxidizing catalyst device 190 which is disposed downstream of the former.

Downstream of the oxidizing catalyst device 190, there is disposed through a first actuator 193 an exhaust supply passage 192 which has communication with a reservoir 191 for reserving metal hydrides or the like, and there is also disposed an exhaust discharge passage 195 for returning again the exhaust gases to the exhaust pipe 16 after having passed through the former reservoir 191.

In order to supply the hydrogen gases, which have been generated of the metal hydrides or the like due to the waste heat of the exhaust gases, to the venturi 196 of the carburetor $C_{22}$, the reservoir 191 is made to have communications with the first and second control fluid passages 204*a* and 205*a* of which exit ports 208 and 209 respectively correspond to first and second control fluid nozzles 204 and 205, which are respectively opened to face a main nozzle 197 and a slow port 203 in the vicinity of the throttle valve 202, through second and third actuators 206 and 207. The aforementioned first, second and third actuators 193, 206 and 207 are electrically connected with the oxygen sensor 17 through the controller 18.

In the carburetor $C_{22}$ thus constructed according to the twenty second embodiment, if the oxygen concentration in the exhaust gases is low (i.e., the air-fuel ratio of the intake mixture being in rich), the oxygen sensor 17 feeds a preset output signal to the controller 18 to operate and turn on the first, second and third actuators 193, 206 and 207 so that hydrogen gases are generated and injected from the exit ports 208 and 209 toward the main nozzle 197 and the slow port 203. As a result, the fuel to be sucked and fed out of the main nozzle 197 and 203 is subjected to the flow resistance coming from the impingement with the hydrogen gases so that its flow rate can be controlled precisely and efficiently. As compared with the foregoing carburetors, moreover, finer control can be attained by controlling the slow system, too.

As a result, the carburetor $C_{22}$ of the twenty second embodiment can enjoy the operational effects that the air and fuel can be controlled to the most proper air-fuel ratio, that the lean combustion can be realized by the addition of the hydrogen gases, while inviting the practically significant effect of reduction in the cost for the fuel, and that the combustion can be so improved as to remarkably improve the exhaust cleaning efficiency, in addition to substantially the same operational effects as those of the aforementioned respective embodiments.

Figure 53:
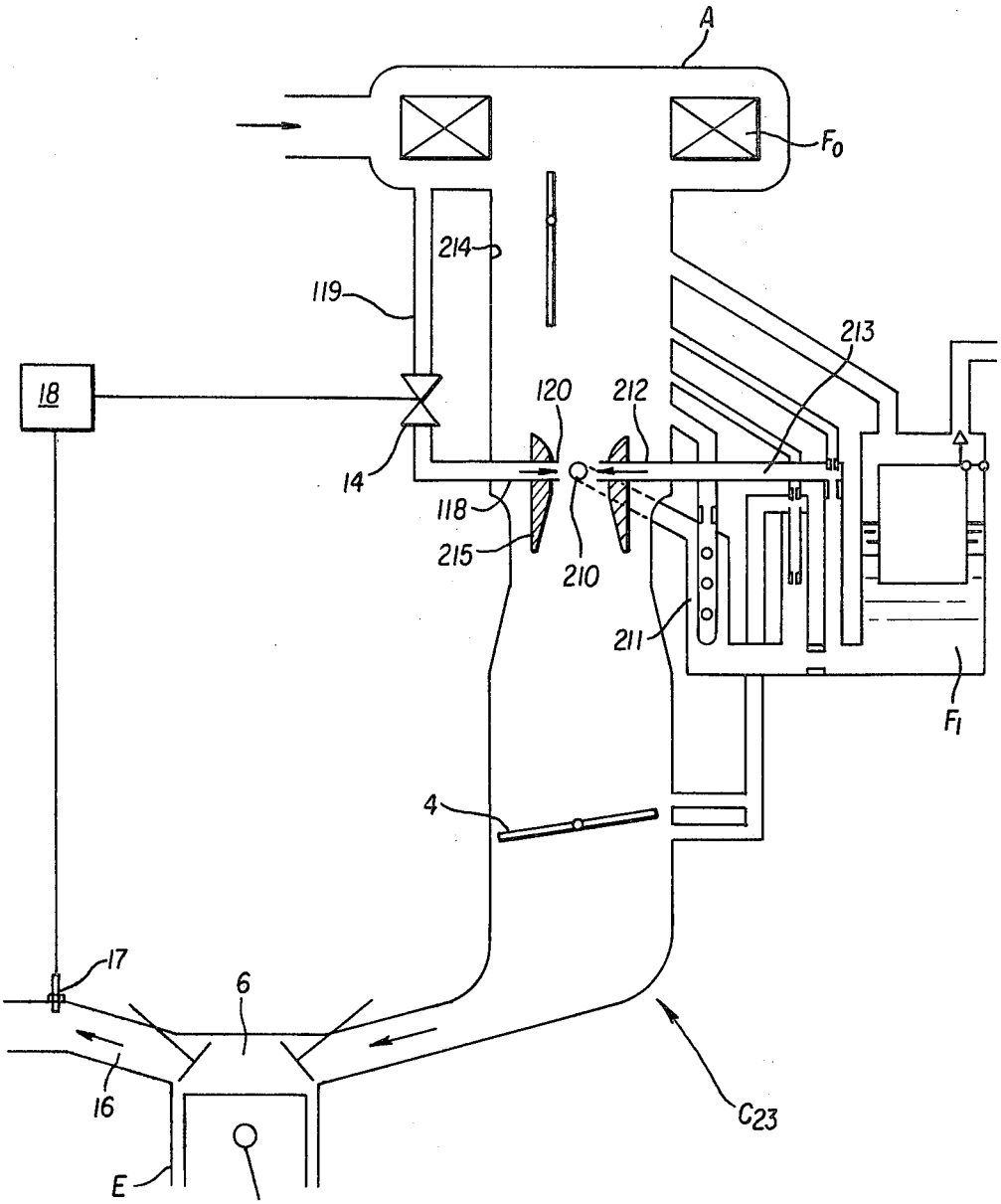
FIG. 53 is a schematic view showing the carburetor according to a twenty third embodiment of the present invention.

Next, a carburetor $C_{23}$ of the twenty third embodiment belonging to the first example of the first aspect in the present invention is constructed, as shown in FIG. 53, such that there are provided a lean mixture preparing main system fuel passage 211 for feeding a fuel in a lower quantity than the proper value of the main system fuel from a first main nozzle 210 and an air-fuel ratio controlling main system fuel passage 213 for feeding a fuel in a quantity according to the running conditions of the engine E from a second main nozzle 212, that these two main system fuel passages 211 and 213 for feeding a proper quantity of the main system fuel as a whole have their respective first and second main nozzles opened into the venturi 215 of the intake passage 214, and that a control fluid passage 119 equipped with a throttle means includes a control fluid nozzle 118 as an exit port 120 thereof opened to face the air-fuel ratio controlling main system fuel passage.

In the caburetor $C_{23}$ thus constructed according to the twenty third embodiment of the present invention, an air-fuel mixture suitable for the engine running conditions can be prepared by controlling the flow rate of the control fluid through the operations of the throttle means.

The twenty fourth embodiment belonging to the first mode of the second example of the second aspect in the present invention will be described in the following with reference to FIG. 54. A carburetor $C_{24}$ according to this embodiment is directed to the case, in which an air injection type is used as a secondary air type feedback system. In a low speed operation, the secondary air type feedback system is used, whereas in a medium or high speed operation air injection type feedback system is used. More specifically, the carburetor $C_{24}$ is constructed such that a control valve 139 is arranged upstream of the backflow check device 137. And, the base air-fuel ratio for the carburetor $C_{24}$ is set at a rich side. During the idle or low speed operation or at a cold start, since a relatively rich mixture is required, the mixture is supplied as it is at the base air-fuel ratio, and secondary air is added at the exhaust side so that the mixture may be prepared to have a stoichiometric ratio which is suitable for the three-way catalyst. During the medium or high speed operation, the mixture is prepared at the intake side by the air jet to have a stoichiometric ratio. Thus, it is possible to provide a carburetor which is free from the deterioration in the fuel consumption rate due to the secondary air system, while preventing the catalyst from being overheated and while ensuring excellent drivability.

Although only representatives of the present invention have been described hereinbefore in connection with the embodiments and modifications, the present invention should not be limited thereto but can be so further modified to allow the embodiments to interchange their components or parts.

Obviously, numerous modifications and variations of the present invention are possible in light of the above teachings. It is therefore to be understood that within the scope of the appended claims, the invention may be practiced otherwise than as specifically described herein.

What is claimed is:

1. A jet control type carburetor comprising an intake pipe having an intake passage formed in an inner wall thereof, said intake passage allowing an intake air to flow therethrough;

a venturi provided in said intake pipe, for increasing flow velocity of said intake air in said intake passage to reduce the pressure thereof;

a fuel nozzle opened into said intake passage and connected to a fuel supply source through a fuel passage for supplying the fuel into said intake passage from said fuel nozzle in order to introduce the mixture of air and fuel into said intake passage;

a throttle valve provided downstream of said venturi, for controlling the flow rate of said mixture of intake air and fuel;

a control fluid nozzle opened into said intake passage at a point upstream from said throttle valve and including the position of said throttle valve, said control fluid nozzle being in coaxial opposition to said fuel nozzle, said control fluid nozzle being connected to a fluid supply source through a control fluid passage for directly jetting the flow of said control fluid to the fuel spurted from said fuel nozzle to afford a predetermined velocity component of said control fluid having a directional sense contrary to that of the spurted fuel thereby to cause said control fluid to impinge upon said fuel spurted from said fuel nozzle and to restrain the fuel flow rate from said fuel nozzle; and a throttle means provided upstream of said control fluid nozzle in said control fluid passage, for controlling the flow rate of said control fluid in accordance with a driving condition of an engine;

whereby the fuel flow rate and the mixing condition of the fuel and the air are controlled over a wide range of the driving conditions of said engine with high stability and response by the predetermined velocity component of the control fluid so that the exhaust gas purification and the fuel consumption are improved by controlling accurately the air-fuel ratio of the intake mixture.

2. A jet control type carburetor according to claim 1, wherein said control fluid nozzle is disposed at a portion under the low pressure in said intake passage; and said control fluid passage is connected to a portion under the high pressure in said intake passage;

thereby jetting the flow of said control fluid to the fuel spurted from said fuel nozzle by utilizing the pressure difference in said intake passage.

3. A jet control type carburetor according to claim 1, wherein said fluid supply source supplies the control fluid having a predetermined pressure;

thereby jetting the flow of said pressurized control fluid to the fuel spurted from said fuel nozzle.

4. A jet control type carburetor according to claim 1, wherein said control fluid jetted from said control fluid nozzle is one selected from the group of air, exhaust gases and hydrogen gases, and said fuel supplied from said fuel nozzle is one selected from the group of gasoline and propane gas.

5. A jet control type carburetor according to claim 1, wherein said throttle means comprises a variable throttle for controlling the area of a throttle port thereof and the flow ratio of the control fluid.

6. A jet control type carburetor according to claim 1, wherein said throttle means comprises a fixed throttle having a throttle port of constant area.

7. A jet control type carburetor according to claim 1, wherein said control fluid nozzle is provided at said venturi to which a main fuel nozzle of said fuel nozzle is opened.

8. A jet control type carburetor according to claim 1, wherein said control fluid nozzle is provided at a portion of said intake passage at which a slow port of said fuel nozzle is provided.

9. A jet control type carburetor according to claim 7, wherein a second said control fluid nozzle is further provided at a portion of said intake passage at which a slow port of said fuel nozzle is provided.

10. A jet control type carburetor according to claim 9, wherein said control fluid passage has a dividing passage connected to a portion positioned downstream of said throttle means in said control fluid passage and a portion positioned downstream of an air bleed in said fuel passage, thereby controlling the flow rate of the fuel from said air bleed.

11. A jet control type carburetor according to claim 1, wherein said control fluid nozzle for said slow port is opened to an air chamber having a predetermined volume located upstream of said slow port in said fuel passage.

12. A jet control type carburetor according to claim 7, further comprising a control fluid passage connected to a fluid supply source and opened to a portion nearby said slow port in said intake passage, thereby controlling the static pressure at said portion nearby said slow port in said intake passage.

13. A jet control type carburetor according to claim 3, wherein said fluid supply source comprises a pump means driven by an engine to which the mixture of the air and fuel is supplied from said caburetor, said pump means supplies the control fluid having a predetermined pressure in response to the driving condition of said engine.

14. A jet control type carburetor according to claim 9, wherein a main control fluid passage connects a fluid supply source and a main control fluid nozzle provided at said venturi and having a throttle means, and a slow control fluid passage connects a fluid supply source and a slow control fluid nozzle provided near by said slow port and having a throttle means.

15. A jet control type carburetor according to claim 9, wherein said control fluid passage comprises divided two control fluid passages, one being connected to a main control fluid nozzle provided at said venturi, and the other being connected to a slow control fluid nozzle provided near by said slow port.

16. A jet control type carburetor according to claim 2, wherein said control fluid nozzle is opposedly provided to said fuel nozzle at a small venturi of a double venturi provided in said intake passage.

17. A jet control type carburetor according to claim 16, wherein said control fluid passage is connected to a portion located downstream of an air cleaner in said intake passage.

18. A jet control type carburetor according to claim 17, wherein said throttle means comprises a variable throttle comprising a throttle port, a needle inserted within said throttle port, and an actuator connected to said needle for controlling the on-off time ratio of said throttle port by a controller connected to an oxygen sensor inserted within an exhaust pipe of an engine.

19. A jet control type carburetor according to claim 2, wherein said control fluid nozzle is opposedly provided to said fuel nozzle comprising a throttle, and a movable needle inserted within said throttle at a variable venturi, and said control fluid passage is connected to a portion located upstream of said variable venturi in said intake passage.

20. A jet control type carburetor according to claim 19, wherein said throttle means comprises a variable throttle comprising a throttle port, a needle inserted within said throttle port, and an actuator connected to said needle for controlling the on-off time ratio of said throttle port by a controller connected to an oxygen sensor inserted within an exhaust pipe of an engine.

21. A jet control type carburetor according to claim 2, wherein said control fluid nozzle is provided at a movable venturi of a variable venturi and is opposed to said fuel nozzle comprising a throttle and a movable needle inserted within said throttle and equipped in said movable venturi.

22. A jet control type carburetor according to claim 2 or 18, wherein said control fluid nozzle and fuel nozzle comprise a tube means penetrating through said small venturi and having a plurality of holes at a side wall thereof, and said control fluid passage and fuel passage are respectively connected to both ends of said tube means, thereby jetting the control fluid to the fuel within said tube means, and spurting the control fluid and the fuel into said intake passage from said plurality of holes of said tube means.

23. A jet control type carburetor according to claim 2 or 18, wherein said fuel nozzle comprises a tube means penetrating through said small venturi and having a plurality of holes at a side wall thereof, and said control fluid nozzle inserted within said tube means, thereby jetting the control fluid from said control fluid nozzle to the fuel within said tube means and spurting the control fluid and the fuel into said intake passage from said plurality of holes of said tube means.

24. A jet control type carburetor according to claim 2 or 18, wherein said fuel nozzle comprises a tube means penetrating through said small venturi and having a notched opening at a side wall thereof, and said control fluid nozzle is inserted within said tube means, thereby jetting the control fluid from said control fluid nozzle to the fuel within said tube means and spurting the control fluid and the fuel into said intake passage from said notched opening of said tube means.

25. A jet control type carburetor according to claim 2 or 18, wherein said control fluid nozzle and said fuel nozzle are opposedly provided below a distribution bar having a circular cross section for penetrating through said small venturi and for promoting the mixing of the fuel and intake air.

26. A jet control type caburetor according to claim 2 or 18, wherein said control fluid nozzle and said fuel nozzle are opposedly provided below a distribution plate having an arc shaped cross section for penetrating through said small venturi and for promoting the mixing of the intake air and fuel.

27. A jet control type carburetor according to claim 2 or 18, wherein said control fluid nozzle comprises a pipe having a tapered exit for changing the direction of the flow of said control fluid to the axis thereof, and said fuel nozzle comprises a pipe, having a smaller diameter than that of said pipe for said control fluid nozzle and an exit, interposed coaxially within said control fluid nozzle, said exit of said fuel nozzle being provided adjacent to said tapered exit of said control fluid nozzle within said control fluid pipe, thereby jetting the changed flow of said control fluid to the fuel spurted from said exit of said fuel nozzle in said tapered exit of said control fluid nozzle.

28. A jet control type carburetor according to claim 18, further comprising a control fluid passage connected to a portion located downstream of an air cleaner in said intake passage and to a portion nearby a slow port in said intake passage, and a variable throttle provided in said control fluid passage, thereby controlling the static pressure at said portion nearby said slow port in said intake passage.

29. A jet control type carburetor according to claim 12, wherein each of said control fluid passages is connected to a passage opened to a portion located upstream of a small venturi of a double venturi in said intake passage through each of variable throttles.

30. A jet control type carburetor according to claim 12, wherein each of said control fluid passages is connected to a passage opened to a large venturi of a double venturi in said intake passage through each of variable throttles.

31. A jet control type carburetor according to claim 12, wherein each of said control fluid passages is connected to a passage opened to a portion located downstream of a large venturi of a double venturi in said intake passage through each of variable throttles.

32. A jet control type carburetor according to claim 12, wherein said control fluid passages are connected to a passage opened to a portion located upstream of said venturi in said intake passage through a single electromagnetic valve.

33. A jet control type carburetor according to claim 18, further comprising a control fluid nozzle opposedly provided to a slow port, and a control fluid passage connected to said control fluid nozzle through a pipe provided at an outer wall of said intake pipe and penetrated said intake pipe and connected to a portion located downstream of said air cleaner in said intake passage through a variable throttle.

34. A jet control type carburetor according to claim 14, wherein said main and slow control fluid passages are connected to a portion located downstream of an air cleaner in said intake passage, and said slow control fluid nozzle is opened to a fuel passage located downstream of a fuel discharge port of said slow port in a wall of said intake pipe.

35. A jet control type carburetor according to claim 14, wherein said main and slow control fluid passages are connected to a portion located upstream of said venturi in said intake passage, and said slow control fluid nozzle is opened with a right angle to the axis of an idle port.

36. A jet control type carburetor according to claim 14, wherein said slow control fluid passage is connected to said slow control fluid nozzle through a passage formed within a throttle shaft of said throttle valve.

37. A jet control type carburetor according to claim 14, wherein said slow control fluid passage is connected to said slow control fluid nozzle through a bent passage provided outside the rotating range of said throttle valve.

38. A jet control type carburetor according to claim 14, further comprising a first communicating passage connected to said main control fluid passage between said main control fluid nozzle and throttle means and to said fuel passage between said fuel nozzle and an air bleed, and a second communicating passage connected to said slow control fluid passage between said slow control fluid nozzle and throttle means and to a fuel passage between said slow port and said air bleed.

39. A jet control type carburetor according to claim 14, wherein said fuel nozzle is directly connected to a float chamber through a main fuel passage, said slow port is directly connected to a float chamber through a slow fuel passage, and each of said main and slow control fluid passages is connected to a portion located downstream of said air cleaner in said intake passage through each of variable throttles.

40. A jet control type carburetor according to claim 18, further comprising a control fluid passage connected to a portion located downstream of said air cleaner in said intake passage through a variable throttle controlled by the signal of said oxygen sensor, an air chamber formed just upstream of a slow port in a slow fuel passage, and a control fluid nozzle connected to said control fluid passage and opened to said air chamber.

41. A jet control type carburetor according to claim 15, wherein said fluid supply source comprised an air pump, controlled by the signal of an oxygen sensor inserted within an exhaust pipe of an engine, for controlling the discharge pressure of air in accordance with the running condition of said engine, said divided two control fluid passages have respectively fixed throttles having a predetermined throttle areas, said main control fluid nozzle is opposedly provided to said main fuel nozzle, and said slow control fluid nozzle is opposedly provided to said slow port.

42. A jet control type carburetor according to claim 3, wherein said fluid supply source comprises an air pump driven by an engine, said control fluid nozzle is opposedly provided to a main fuel nozzle in a small venturi of a double venturi, and said throttle means comprises a variable throttle comprising an actuator controlled by a controller connected to an oxygen sensor inserted within an exhaust passage of an engine.

43. A jet control type carburetor according to claim 42, further comprising a slow control fluid nozzle is opposedly provided to a slow port, a slow control fluid passage is connected to said slow control fluid nozzle and said air pump, and a variable throttle is provided in said slow control fluid passage and comprises said actuator controlled by a controller connected to said oxygen sensor.

44. A jet control type carburetor according to claim 3, wherein said control fluid passage is connected to an exhaust passage of an engine, said control fluid nozzle is opposedly provided to a main fuel nozzle in a small venturi of a double venturi, and said throttle means comprises a variable throttle comprising an actuator controlled by a controller connected to an oxygen sensor inserted within said exhaust passage.

45. A jet control type carburetor according to claim 44, further comprising a slow control fluid nozzle is opposedly provided to a slow port, a slow control fluid passage is connected to said slow control fluid nozzle and said exhaust passage of said engine, and a variable throttle is provided in said slow control fluid passage and comprises an acutator controlled by a controller connected to said oxygen sensor.

46. A jet control type carburetor according to claim 3, wherein said fluid supply source comprises a reservoir in which metal hydrides are reserved, and which has an exhaust supply passage connected to an exhaust passage of an engine through a variable throttle, and an exhaust discharge passage connected to said exhaust passage of said engine, thereby passing the exhaust gases having a high temperature from said engine through said reservoir, and generating the hydrogen gases as a result of the chemical reactions of the metal hydrides, said control fluid nozzle is opposedly provided to a main fuel nozzle in said venturi, said throttle means comprises a variable throttle comprising an actuator controlled by a controller connected to an oxygen sensor inserted within said exhaust passage of said engine, and said controller of said throttle means controlls said variable throttle of said exhaust supply passage.

47. A jet control type carburetor according to claim 46, further comprising a slow control fluid nozzle is opposedly provided to a slow port, a slow control fluid passage is connected to said slow control fluid nozzle and said reservoir, and a variable throttle is provided in said slow control fluid passage annd comprises an actuator controlled by a controller connected to said oxygen sensor.

48. A jet control type carburetor according to claim 2 or 18, wherein said fuel nozzle comprises a first main fuel nozzle, for feeding a smaller quantity of the fuel, provided with a right angle to the axis of said control fluid nozzle in said small venturi and connected to an air bleed through a fuel passage, and a second main fuel nozzle, for feeding the fuel in a quantity according to running condition of an engine, opposedly provided to said control fluid nozzle and connected to a float chamber through a fuel passage having a passage connected to a portion located upstream of said small venturi in said intake passage.

49. A jet control type carburetor according to 42, further comprising an air supply passage connected to said air pump of said fluid supply source and to a portion located upstream of a catalyst in said exhaust passage, and a variable throttle comprising an actuator controlled by said controller of said throttle means of said control fluid passage.

50. A jet control type carburetor comprising an intake pipe having an intake passage formed in an inner wall thereof, said intake passage allowing an intake air to flow therethrough;

a venturi provided in said intake pipe, for increasing flow velocity of said intake air in said intake passage to reduce the pressure thereof;

a fuel nozzle opened into said intake passage and connected to a fuel supply source through a fuel passage for supplying the fuel into said intake passage from said fuel nozzle in order to introduce the mixture of air and fuel into said intake passage;

a throttle valve provided downstream of said venturi, for controlling the flow rate of said mixture of intake air and fuel;

a control fluid nozzle opened into said intake passage connected to a fluid supply source through a control fluid passage for directly jetting the flow of said control fluid to the fuel spurted from said fuel nozzle to afford a predetermined velocity component of said control fluid having a directional sense contrary to that of the spurted fuel thereby to cause said control fluid to impinge upon said fuel spurted from said fuel nozzle and to restrain the fuel flow rate from said fuel nozzle; and a throttle means provided upstream of said control fluid nozzle in said control fluid passage, for controlling the flow rate of said control fluid in accordance with a driving condition of an engine;

whereby the fuel flow rate and the mixing condition of the fuel and the air are controlled over a wide range of the driving conditions of said engine with high stability and response by the predetermined velocity component of the control fluid so that the exhaust gas purification and the fuel consumption are improved by controlling accurately the air-fuel ratio of the intake mixture;

said control fluid nozzle is disposed at a portion under low pressure in said intake passage, and said control fluid passage is connected to a portion under high pressure in said intake passage, wherein:

said control fluid nozzle is opposedly provided to said fuel nozzle at a small venturi of a double venturi provided in said intake passage;

wherein said control fluid passage is connected to a portion located downstream of an air cleaner in said intake passage;

wherein said throttle means comprises a variable throttle comprising a throttle port, a needle inserted within said throttle port, and an actuator connected to said needle for controlling the on-off time ratio of said throttle port by a controller connected to an oxygen sensor inserted within an exhaust pipe of an engine further comprising:

a second control fluid nozzle opposedly provided to a slow port, and a control fluid passage connected to said second control fluid nozzle through a flexible tube fixed to said throttle valve and connected to a portion located downstream of said air cleaner in said intake passage through a variable throttle.

* * * * *